US011857864B2

(12) United States Patent
Hoffman

(10) Patent No.: US 11,857,864 B2
(45) Date of Patent: Jan. 2, 2024

(54) MOTORIZED PLATFORMS FOR WALKING

(71) Applicant: Shalom Hoffman, Rehovot (IL)

(72) Inventor: Shalom Hoffman, Rehovot (IL)

( * ) Notice: Subject to any disclaimer, the term of this patent is extended or adjusted under 35 U.S.C. 154(b) by 200 days.

(21) Appl. No.: 17/798,996

(22) PCT Filed: Mar. 16, 2020

(86) PCT No.: PCT/IL2020/050310
§ 371 (c)(1),
(2) Date: Aug. 11, 2022

(87) PCT Pub. No.: WO2020/194291
PCT Pub. Date: Oct. 2, 2020

(65) Prior Publication Data

US 2023/0069904 A1 Mar. 9, 2023

(30) Foreign Application Priority Data

Mar. 23, 2019 (GB) ..... 1904018

(51) Int. Cl.
*A63C 17/12* (2006.01)

(52) U.S. Cl.
CPC ..... *A63C 17/12* (2013.01); *A63C 2203/12* (2013.01); *A63C 2203/18* (2013.01); *A63C 2203/22* (2013.01); *A63C 2203/50* (2013.01)

(58) Field of Classification Search
CPC ..... A63C 17/12; A63C 2203/12
See application file for complete search history.

(56) References Cited

U.S. PATENT DOCUMENTS

| | | | | |
|---|---|---|---|---|
| 6,059,062 | A * | 5/2000 | Staelin | B60L 3/0092 180/181 |
| 7,900,731 | B2 | 3/2011 | Mckinzie | |
| 9,027,690 | B2 | 5/2015 | Chavand | |
| 9,295,302 | B1 | 3/2016 | Reed et al. | |
| 9,925,453 | B1 | 3/2018 | Tuli | |
| 10,709,961 | B2 * | 7/2020 | Zhang | A63C 17/12 |
| 11,707,666 | B2 * | 7/2023 | Zhang | A63C 17/262 180/24.09 |
| 2009/0120705 | A1 * | 5/2009 | McKinzie | A63C 17/08 180/181 |
| 2013/0025955 | A1 | 1/2013 | Chavand | |
| 2020/0129844 | A1 * | 4/2020 | Zhang | B60W 50/082 |
| 2021/0015200 | A1 * | 1/2021 | Tuli | A63C 17/12 |
| 2021/0113914 | A1 * | 4/2021 | Zhang | B60L 7/26 |

FOREIGN PATENT DOCUMENTS

| | | | |
|---|---|---|---|
| WO | 2014107653 | A1 | 7/2014 |
| WO | 2016020582 | A1 | 2/2016 |
| WO | 2019014152 | A1 | 1/2019 |

* cited by examiner

*Primary Examiner* — Brian L Swenson
(74) *Attorney, Agent, or Firm* — Dorsey & Whitney LLP

(57) ABSTRACT

The present invention relates to motorized platforms wearable by a user, for enhancing the speed of walking while maintaining stability and reducing overall weight, due to a simplified structure and relatively modest number of components.

20 Claims, 18 Drawing Sheets

MOTORIZED PLATFORMS FOR WALKING

FIELD OF THE INVENTION

The present invention relates to motorized platforms wearable by a user, for enhancing the speed of walking while maintaining stability and reducing overall weight, due to a simplified structure and relatively modest number of components.

BACKGROUND OF THE INVENTION

Walking is the most natural and efficient way to travel short distances, yet it can be time-consuming and/or tedious as an urban transport common tool. Additionally, walking can be also regarded as a form of exercise, which is considered to be pleasant, relaxing and have various health benefits. The average walking rate of users, such as travelers, pedestrians and commuters, is in the range of 4.5 to 5.5 km/h, and is considered as a moderate healthy walking rate. This rate can be increased by the addition of motorized mobility devices containing wheels, attachable to the soles of the user's shoes.

The use of motorized mobility devices has been previously suggested. For example, U.S. Pat. No. 9,027,690 discloses personal transport means for walking at faster speeds than normal walking, made up of a pair of wheeled shoes or wheeled undersoles that can be adapted by quick attachment to the soles of the normal shoes of a walker, laterally articulated to follow the natural movements of the heels relative to the tips of the feet during normal walking, and allowing walking at higher speeds.

U.S. Pat. No. 9,295,302 discloses a gait-altering shoe, including a frame adapted to support a user's foot and at least one wheel that supports the frame above a walking surface, the wheel having a radius that varies as a function of angular position of the wheel.

International Publication No. WO 2019/014152 discloses a mobility device, worn on each foot of a user, comprising a controller for analyzing data from at least one sensor on the mobility device. A sensor obtains data about the gait of a user and transmits the data to a processor. The processor analyzes the gait of a user and then uses the gait data to develop motion commands for each mobility device. The mobility device may comprise a motor, gearing, and wheels.

U.S. Pat. No. 7,900,731 discloses a pair of shoes having retractable motorized wheels, wherein each of the shoes has an upper, a sole, and first and second wheels mounted on the sole and movable from a retracted to an extended position. When the wheels are in an extended position, at least one wheel of one of the shoes engages a battery-powered, DC motor mounted on the shoe.

However, the existing devices may exhibit several drawbacks, such as stability issues, which can be crucial for the average user, who is not an athlete accustomed for fast pace movement or has a heightened sense of equilibrium. There remains an unmet need for simple, cost-efficient and improved motorized mobility devices for the use of average users.

SUMMARY OF THE INVENTION

The present disclosure is directed a mobility enhancement system that includes two motorized platforms wearable over a user's shoes, configured for rolling while walking, wherein the platforms are also lightweight and easily controllable. The system is configured to keep all primary wheels rolling at a constant preset speed at all times, neutralizing any skid forces that may alter the rolling speed of the wheels, advantageously enabling the walker to maintain natural walking balance without needing to make any particular effort.

According to one aspect, there is provided a motorized walking system comprising two motorized walking enhancement platforms, wherein each two motorized walking enhancement platforms comprises a base frame, a drive assembly attached to the base frame, and a control circuitry.

The drive assembly comprises a front lateral sub assembly, a rear lateral sub assembly, a drive line, a front non-differential transmission mechanism, and a rear non-differential transmission mechanism. The front lateral sub assembly comprises a couple of front primary wheels affixed to both sides of a front axle. The rear lateral sub assembly comprises a couple of rear primary wheels affixed to both sides of a rear axle.

The drive line comprises a motor having a motor shaft protruding longitudinally from both sides of the motor, a front longitudinal shaft member coupled to the motor shaft via a front speed reduction unit, and a rear longitudinal shaft member coupled to the motor shaft via a rear speed reduction unit.

The front non-differential transmission mechanism is configured to translate rotational movement of the of the front longitudinal shaft member to rotational movement of the front axle. The rear non-differential transmission mechanism, configured to translate rotational movement of the rear longitudinal shaft member to rotational movement of the rear axle.

The control circuitry is configured to control at least the functionality of the motor. The control circuitry is further configured to receive feedback corresponding to the momentary rotation speed of the primary wheels, compare the momentary rotation speed to a corresponding to a pre-set rotation speed, and if the momentary rotation speed is higher or lower than the pre-set rotation speed, to provide controlling signals configured to neutralize such change by readjusting the rotation torque of the motor, so as to revert the rotation speed of the primary wheels back to the pre-set desired speed.

According to some embodiments, the motor is a brushless DC motor.

According to some embodiments, each of the front gear reduction unit and the rear reduction unit comprises a planetary gear arrangement.

According to some embodiments, each motorized walking enhancement platform further comprises a communication unit, configured to wirelessly communicate with a remote-control device.

According to some embodiments, each drive assembly further comprises at least one rotation speed sensor electronically coupled to the control circuitry, and is configured to continuously measure and generate a signal commensurate with the rotation speed of the component of the drive assembly it is attached to, thereby providing the feedback to the control circuitry.

According to some embodiments, the at least one rotation speed sensor comprises at least two rotation speed sensors, coupled to both sides of the motor shaft.

According to some embodiments, the at least one rotation speed sensor is coupled to at least one of the front axle and/or the rear axle.

According to some embodiments, the at least one rotation speed sensor comprises an absolute encoder.

According to some embodiments, the control circuitry is configured to receive the feedback, perform the comparison and provide readjustment signals to the motor within a time period equal or lower than 0.05 seconds.

According to some embodiments, each motorized walking enhancement platform further comprises a pair of secondary wheels, wherein each secondary wheel is coupled to the base frame via a lever, and wherein the vertical position of each secondary wheel relative to the base frame is displaceable via a lever height regulator.

According to some embodiments, the lever is a rigid pivotable arm, attached to the base frame via a hinge.

According to some embodiments, the lever height regulator is a pneumatic/hydraulic drive unit, comprising a pneumatic/hydraulic piston attached to the lever at a pneumatic/hydraulic piston lower end, and vertically movable through a pneumatic/hydraulic cylinder.

According to some embodiments, the motorized walking enhancement platform further comprises a pair of actuators, wherein each actuator comprises an actuator sub-controller and is coupled to the corresponding pneumatic/hydraulic drive unit via a lever transmission line, and wherein each actuator is configured to control the vertical position of the pneumatic/hydraulic piston lower end.

According to some embodiments, each motorized walking enhancement platform further comprises at least one pressure sensor front pressure sensor coupled to the front lateral sub-assembly, and at least one rear pressure sensor coupled to the rear lateral sub-assembly, and wherein the actuators are configured to control the vertical position of the secondary wheels according to measurement signals generated by the front and rear pressure sensors.

According to some embodiments, each motorized walking enhancement platform further comprises a pair of braking systems, wherein each braking system shares the actuator coupled to the lever height regulator, and further comprising a pneumatic/hydraulic braking unit coupled to the actuator via a braking transmission line, and wherein each braking system is configured to apply friction to a front wheel when a skid force of the front wheel exceeds a predetermined threshold value.

According to some embodiments, the lever height regulator is a spring.

According to some embodiments, each non-differential transmission mechanism comprises a worm-gear transmission mechanism, wherein the corresponding longitudinal shaft member comprises a longitudinal worm gear, and wherein the corresponding axle comprises a lateral worm gear meshed with the longitudinal worm gear.

According to some embodiments, each non-differential transmission mechanism comprises a beveled-gear transmission mechanism, wherein the corresponding longitudinal shaft member comprises a longitudinal bevel gear, and wherein the corresponding axle comprises a lateral bevel gear meshed with the longitudinal bevel gear.

According to some embodiments, the weight of each motorized walking enhancement platform is equal to or lower than 2.5 kg.

According to some embodiments, each motorized walking enhancement platform further comprises an ergonomic leg brace with a shin/calf strap, and configured to house a power source.

According to some embodiments, each motorized walking enhancement platform further comprises at least one adjustable foot strap.

According to some embodiments, each motorized walking enhancement platform further comprises a rear extension, extending upward from a rear frame portion of the base frame.

Certain embodiments of the present invention may include some, all, or none of the above advantages. Further advantages may be readily apparent to those skilled in the art from the figures, descriptions, and claims included herein. Aspects and embodiments of the invention are further described in the specification herein below and in the appended claims.

Unless otherwise defined, all technical and scientific terms used herein have the same meaning as commonly understood by one of ordinary skill in the art to which this invention pertains. In case of conflict, the patent specification, including definitions, governs. As used herein, the indefinite articles "a" and "an" mean "at least one" or "one or more" unless the context clearly dictates otherwise.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION OF SOME EMBODIMENTS

Figure 1:
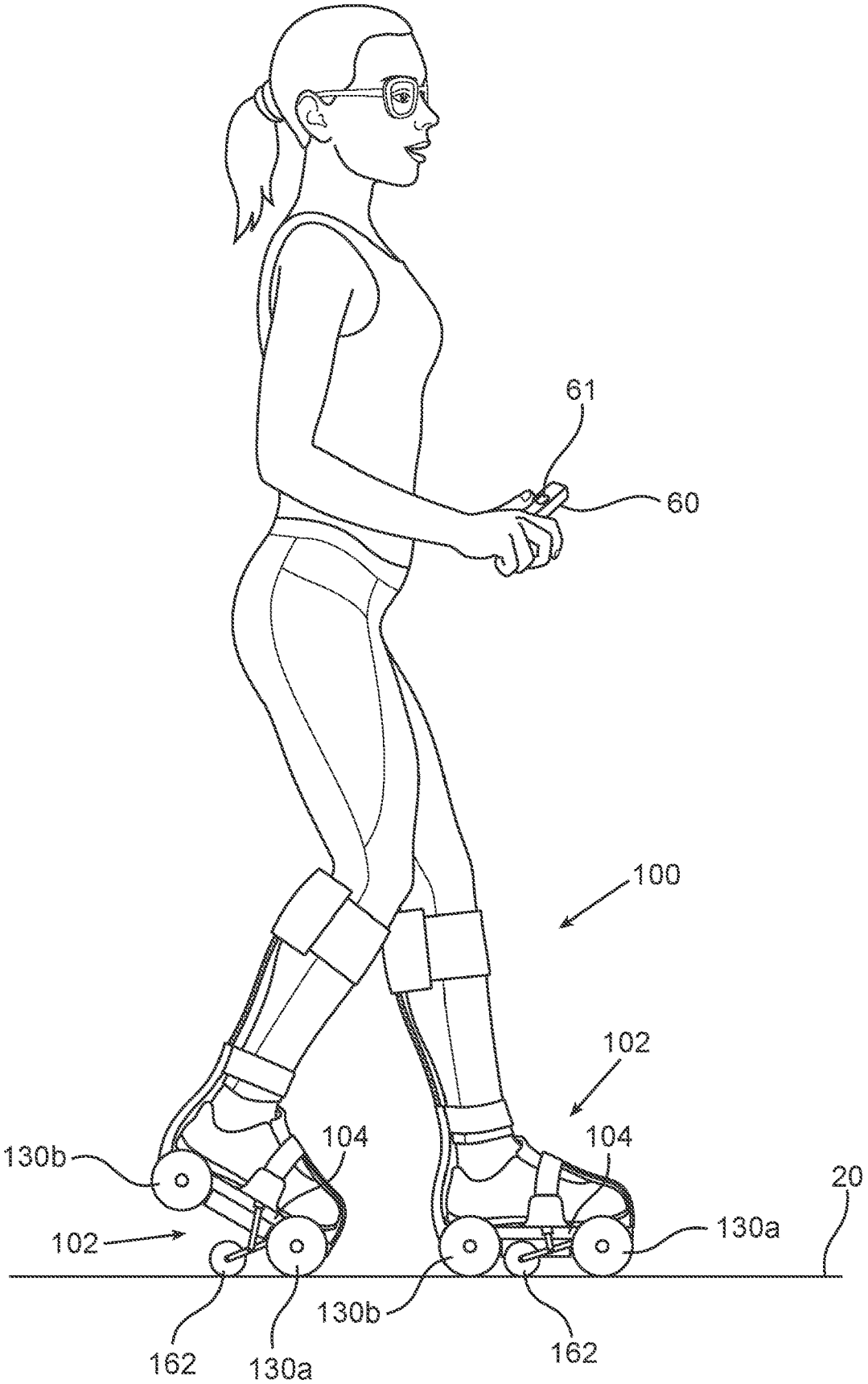
FIG. 1 shows a user wearing a nobility enhancement system, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure. In order to avoid undue clutter from having too many reference numbers and lead lines on a particular drawing, some components will be introduced via one or more drawings and not explicitly identified in every subsequent drawing that contains that component.

Throughout the figures of the drawings, different superscripts for the same reference numerals are used to denote different embodiments of the same elements. Embodiments of the disclosed devices and systems may include any combination of different embodiments of the same elements. Specifically, any reference to an element without a superscript may refer to any alternative embodiment of the same element denoted with a superscript.

Reference is now made to FIGS. 1-4. FIG. 1 shows a user wearing a nobility enhancement system 100, according to some embodiments. FIG. 2A shows a schematic plan view of a motorized walking enhancement platform 102, according to some embodiments. FIG. 2A shows a schematic plan view of the motorized walking enhancement platform 102 of FIG. 2A, hiding some components thereof and emphasizing components of a drive assembly 124, for clarity. FIG. 2C shows a schematic plan view of the motorized walking enhancement platform 102 of FIG. 2A, hiding some components thereof and emphasizing components of a pneumatic/hydraulic sub-systems, such as a pneumatic/hydraulic lever height regulator 270 and a pneumatic/hydraulic braking system 194, both sharing a common actuator 182. FIG. 2D shows a schematic plan view of the motorized walking enhancement platform 102 of FIG. 2A, hiding some components thereof and emphasizing components of a pneumatic/hydraulic braking system 194, for clarity. FIG. 2E shows a schematic plan view of the motorized walking enhancement platform 102 of FIG. 2A, hiding some components thereof and emphasizing components of a pneumatic/hydraulic lever height regulator 270, for clarity.

Figure 3:
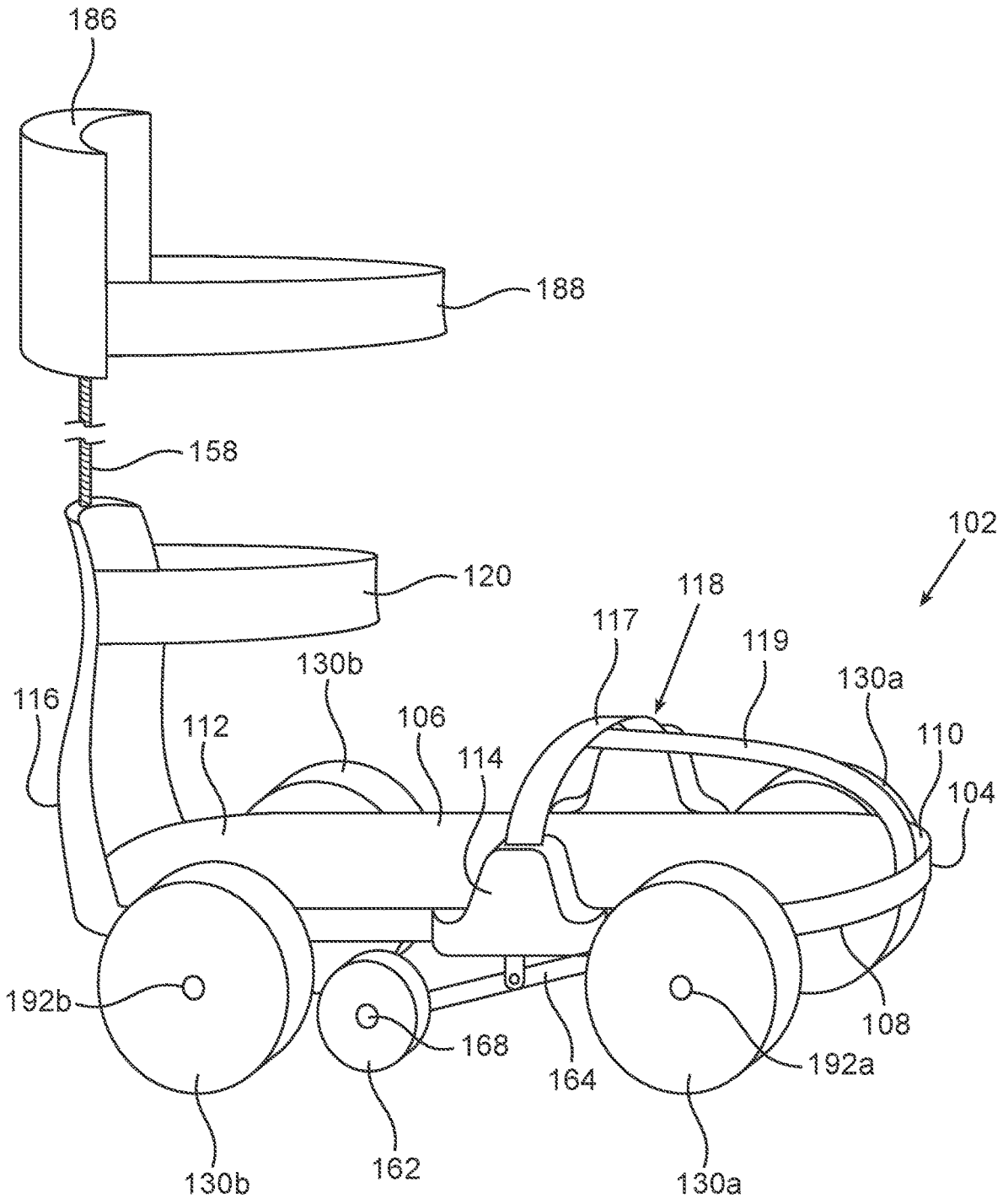
FIG. 3 shows a view in perspective of a motorized walking enhancement platform, according to some embodiments.
Figure 4A:
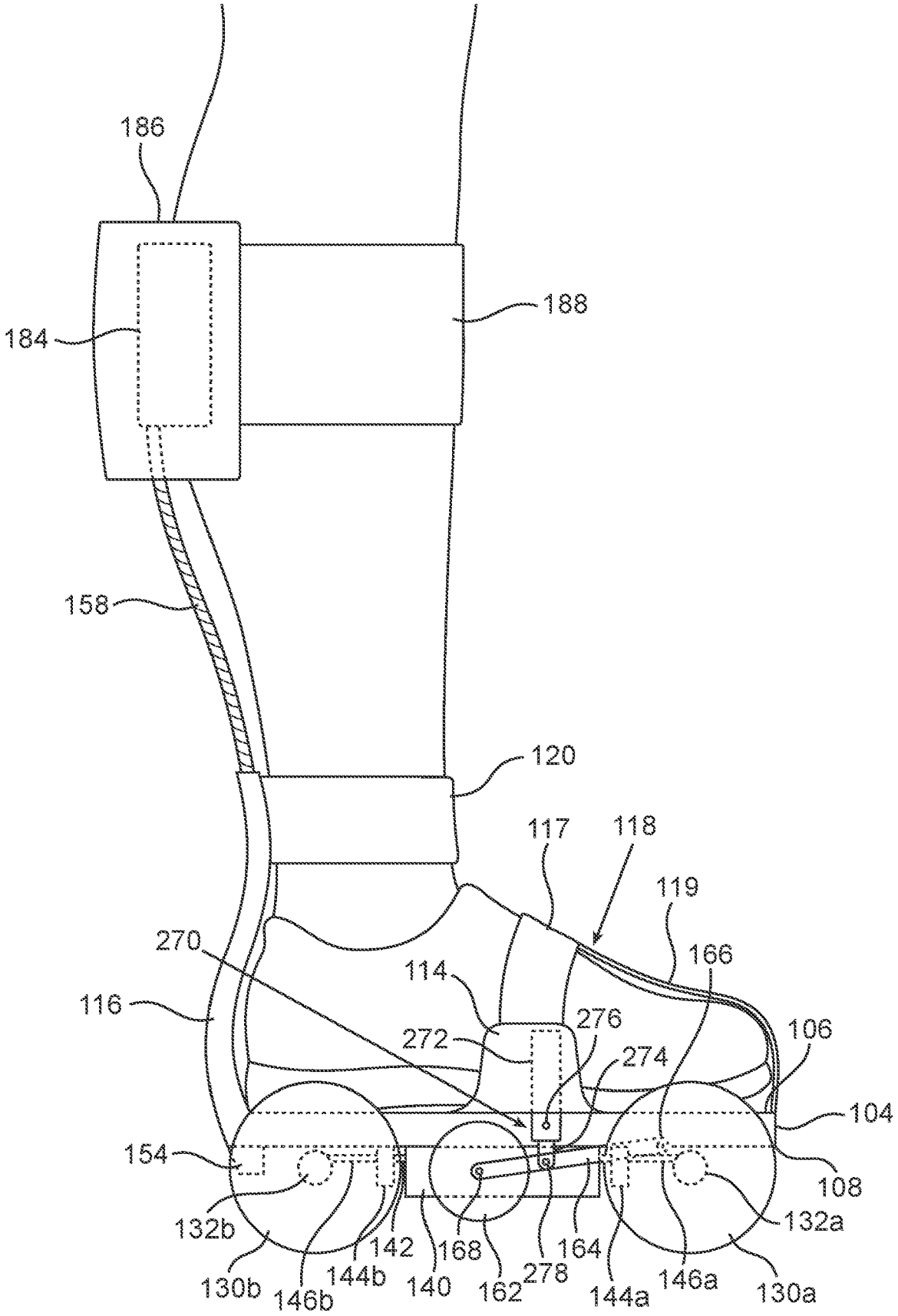
FIG. 4A shows a side view of a motorized walking enhancement platform with lever height regulator in a retracted state, according to some embodiments.
Figure 4B:
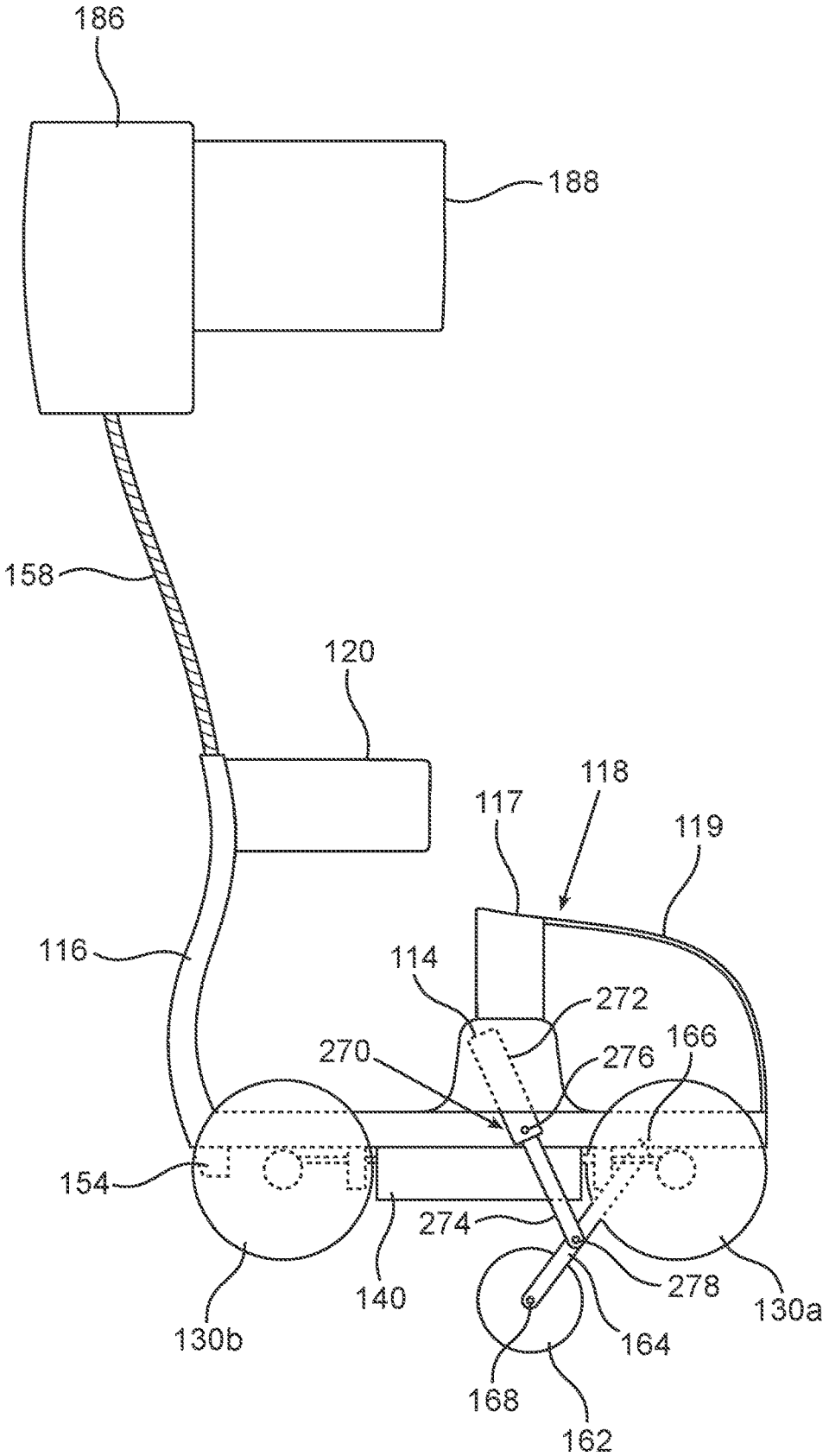
FIG. 4B shows a side view of a motorized walking enhancement platform with lever height regulator in a lowered state, according to some embodiments.

FIG. 3 shows a view in perspective of a motorized walking enhancement platform 102, according to some embodiments. FIGS. 4A and 4B show side views of a motorized walking enhancement platform 102 with lever height regulators in various states, according to some embodiments.

The terms "including" and/or "having", as used herein, are defined as comprising (i.e., open language).

As shown in FIG. 1, a motorized walking system 100 includes two motorized walking enhancement platforms 102, each of which is attachable to one of the legs of a user (e.g., a walker), when walking over a relatively flat ground 20. A first motorized walking platform 102 can be worn on the left foot of the user, and a second motorized walking platform 102 can be worn on the right foot of the user. Hereinafter, a single motorized walking platform 102 will be described, simply for ease of discussion and illustration. However, the features to be described for the single motorized walking platform 102 may be applied to the left motorized walking platform as well as the right motorized walking platform.

Figure 2A:
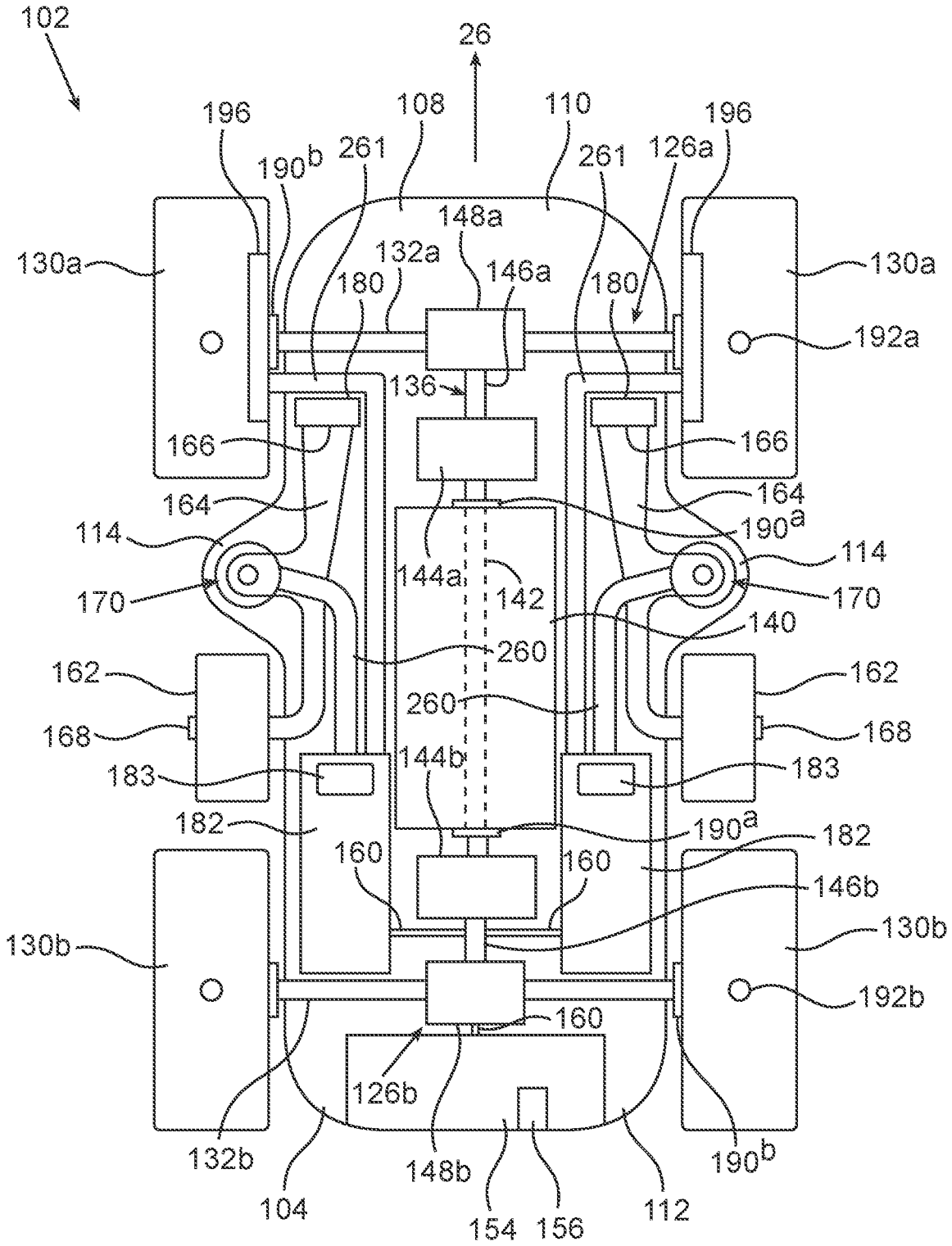
FIG. 2A shows a schematic plan view of a motorized walking enhancement platform, according to some embodiments.
Figure 2B:
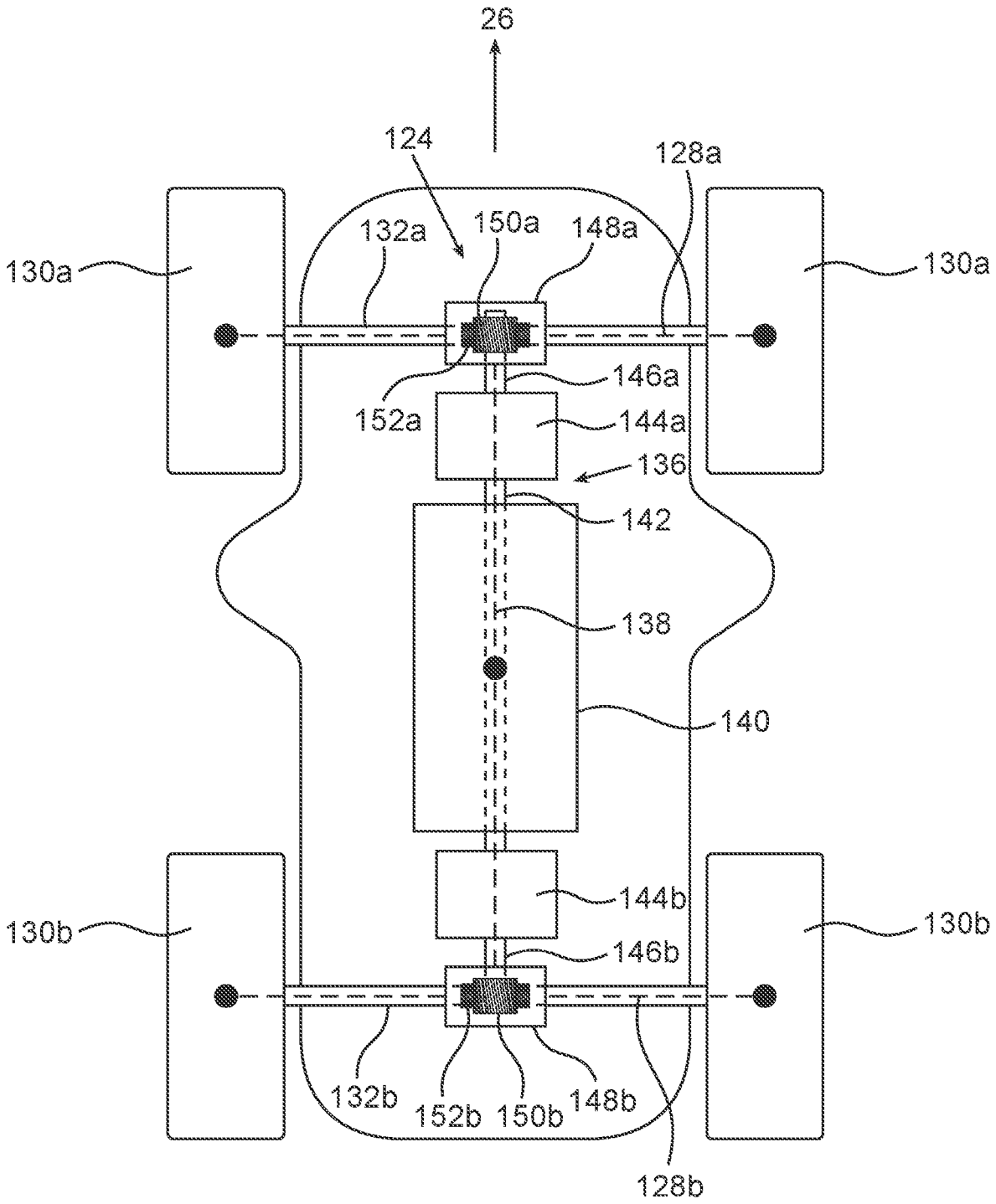
FIG. 2B shows a schematic plan view of a drive assembly of a motorized walking enhancement platform, according to some embodiments.
Figure 2C:
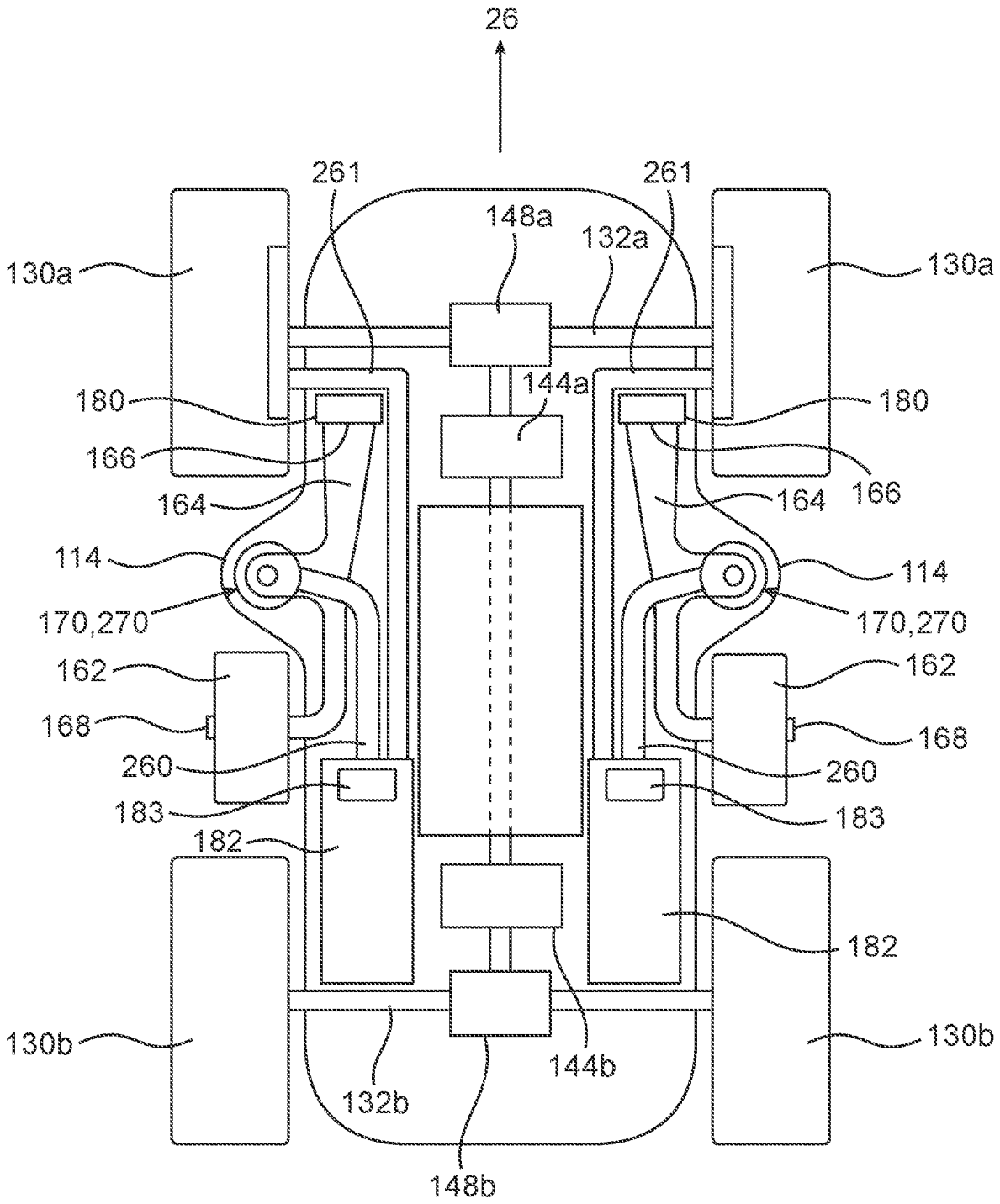
FIG. 2C shows a schematic plan view of a pneumatic/hydraulic sub-systems of a motorized walking enhancement platform, according to some embodiments.
Figure 2D:
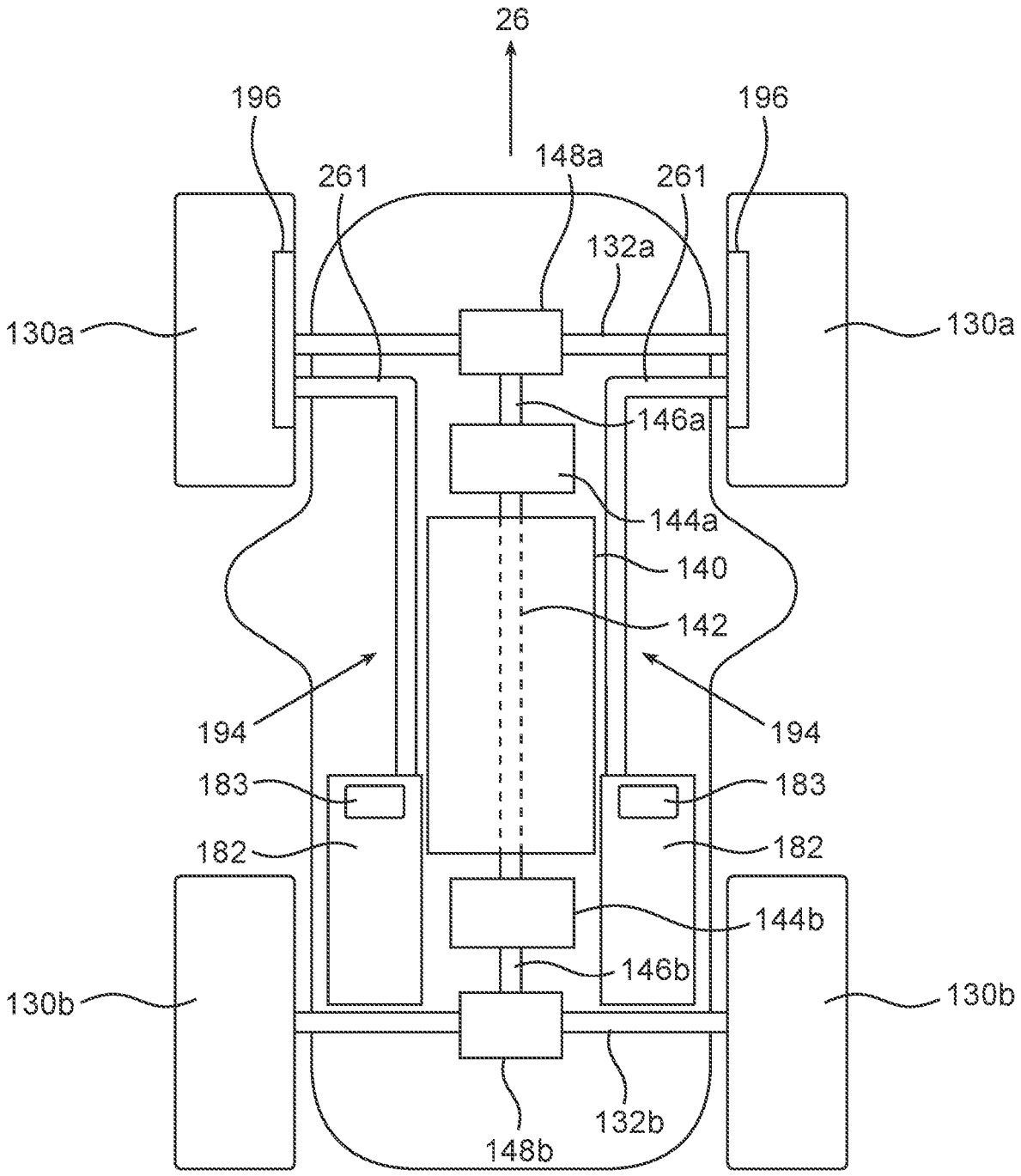
FIG. 2D shows a schematic plan view of a motorized walking enhancement platform with a pneumatic/hydraulic braking system, according to some embodiments.

As further shown in FIGS. 2A-3, each motorized walking platform 102 comprises a base frame 104 on which the shoe of the user may be positioned. The motorized walking platform 102 may be attached to the shoe of the user by various attachment means, such as at least one adjustable foot strap 118. In some embodiments, the foot strap 118 comprises a lateral strap section 117 and a longitudinal strap section 119, so as to support the walker's show in both sideways and frontal directions. The foot strap 118 can be adjustable to accommodate different sizes and types of shoes, different user preferences for tightness, and the like. Additional straps, such as an ankle strap 120 and a shin/calf strap 188 can be utilized to enhance the platform's 102 stability and attachment to the user's leg.

The base frame 104 extends between a front frame portion 110 and a rear frame portion 112, and comprises an upper frame surface 106 facing upward, toward the torso of the user, and a lower frame surface 108 facing downward, toward the ground. The upper frame surface 106 and the lower frame surface 108 are not necessarily flat, and may each consist curved or otherwise uneven portions, that may be designed to accept various components or articles thereon. Generally, the upper frame surface 106 is designed to accept the sole of a user's shoe, while the lower frame surface 108 may include various attachments to mechanical and/or electrical components of the motorized walking enhancement platform 102.

The term "lower", as used herein, refers to a side of a device or a component of a device facing the ground 20. The term "upper", as used herein, refers to a direction facing away from the ground 20, for example toward the torso of a user wearing the motorized walking system 100.

The term "flat", as used herein, refers to a surface that is without significant projections or depressions.

The base frame 104 may be formed as a relatively solid material, which can be uniformly formed from one component, made for example from metallic or relatively rigid polymeric materials, or from several parts rigidly attached to each other to form together a substantially stiff frame structure.

The motorized walking platforms 102 further comprises a drive assembly 124 attached to the base frame 104, configured to enable assisted rolling of the base frame 104 during standard walking movement of the user. As further emphasized in FIG. 2B, the drive assembly comprises at least two pairs of primary wheels 130, such as a pair of front primary wheels 130*a* and a pair of rear primary wheels 130*b*. The primary wheels 130 are configured to be powered so as to rotate about their lateral axes 128, when the motorized walking platform 102 is turned on to an assisted rolling state, as will be elaborated below.

The drive assembly 124 comprises at least two lateral sub-assemblies 126, wherein each lateral sub-assembly 126 comprises a corresponding pair of primary wheels 130 affixed to both sides of an axle 132 extending laterally therebetween, such that the primary wheels 130 are configured to rotate along with the axle 132. Specifically, a front lateral sub-assembly 126*a* comprises a front axle 132*a* extending along a front lateral axis 128*a*, coupled to the front primary wheels 130*a* at both sides thereof. Similarly, a rear lateral sub-assembly 126*b* comprises a rear axle 132*b* extending along a rear lateral axis 128*b*, coupled to the rear primary wheels 130*b* at both sides thereof.

The drive assembly 124 further comprises a drive line 136, longitudinally disposed along a longitudinal axis 138 between the front lateral sub-assembly 126*a* and the rear lateral sub-assembly 126*b*. The drive line 136 comprises a motor 140 positioned between the front and rear axles 132*a* and 132*b*, respectively, a pair of speed reduction units 144 positioned on both sides of the motor 140, and a pair of longitudinal shaft members 146 extending between each one of the speed reduction units 144 and a corresponding axle 132.

The term "longitudinal", as used herein, refers to a direction, orientation, or measurement that is parallel to the longitudinal axis 138. When expressed in relation to a direction of walking or movement of a user (e.g., a walker), the term "longitudinal" refers to a direction that is parallel to the longitudinal axis 138 when all of the primary wheels 130 of the motorized walking enhancement platform 102 are in contact with the ground 20. The term "lateral", as used herein, refers to a direction, orientation, or measurement that is perpendicular to the longitudinal axis 138, and is parallel to either the lateral axes 128. The forward direction 26 represents the direction of advancement along the longitudinal direction.

The motor 140 comprises a motor shaft 142 protruding longitudinally from both sides of the motor 140. Each side of the motor shaft 142 is coupled to a speed reduction unit 144. For example, a front portion of the motor shaft 142 is coupled to a front speed reduction unit 144*a*, and a front longitudinal shaft member 146*a* is coupled to the opposite side of the front speed reduction unit 144*a*, extending toward the front axle 132*a*. Similarly, a rear portion of the motor shaft 142 is coupled to a rear speed reduction unit 144*b*, and a rear longitudinal shaft member 146*b* is coupled to the opposite side of the rear speed reduction unit 144*b*, extending toward the rear axle 132*b*. The motor shaft 142 and the longitudinal shaft members 146 maybe arranged longitudinally, either coaxially along or in parallel to the longitudinal axis 138.

Since both lateral sub-assemblies 126 are coupled to the same drive line 136, the motor 140 is configured to simultaneously drive the front and rear primary wheels 130*a*, 130*b* at the same speed at any instant. In some implementations, the motor 140 is a brushless DC (BLDC) motor. The motor 140 may further be a slotted or slotless BLDC motor.

Each speed reduction unit 144 can include, in some implementations, one or more planetary gear arrangements or other suitable gear reducer assembly arrangements linking the motor to the corresponding lateral sub-assembly 126. In still other implementations, gearing arrangements other than planetary reduction gear assemblies could be employed within the speed reduction units 144, such as a harmonic gear arrangement. Advantageously, a planetary or harmonic gear arrangement may provide additional torque.

Preferably, the drive assembly 124 is driven by a small and relatively lightweight motor, such as an efficient BLDC motor using speed reduction units 144 to create the high torque required to start the mobility enhancement system 100 smoothly under the load of a user wearing the platforms 102. BLDC motors have higher torque and power densities than brushed motors, yielding more torque and power in a smaller and lighter package. This significantly lowers the size of the motor compared to utilization of brushed DC motors.

As shown, the motor 140 may be positioned on the lower frame surface 108, between the front axle 132*a* and the rear axle 132*b*. The motor load allocated to the rear lateral sub assembly 126*b* may be significantly lower than the motor load allocated to the front lateral sub assembly 126*a* at all phases of a walker's step. Thus, in some embodiments, each of the front speed reduction unit 144*a* and the rear speed reduction unit 144*b*, and/or each of the front non-differential transmission mechanism 148*a* and the rear non-differential transmission mechanism 148*b*, is configured allow differentiation and optimization of the torque transferred from the motor 140 to the respective lateral sub-assembly 126.

According to some embodiments, the motor 140 comprises a plurality of motor units, such as a plurality of micro BLDC motors, that can be serially mounted on a single motor shaft 142, with appropriate speed reduction units 144 mounted on both sides of the motor shaft 142.

The drive assembly further comprises at least two non-differential transmission mechanisms 148, configured to translate the rotational movement of the drive line 136 about its longitudinal axis 138, to a rotational movement of the axles 132 about their lateral axes 128. Specifically, a front non-differential transmission mechanism 148*a* is configured to translate rotational movement of the front longitudinal shaft member 146*a* to a rotational movement of the perpendicularly oriented front axle 132*a*, which in turn rotates the front primary wheels 130*a*. Similarly, a rear non-differential transmission mechanism 148*b* is configured to translate rotational movement of the rear longitudinal shaft member 146*b* to a rotational movement of the perpendicularly oriented rear axle 132*b*, which in turn rotates the read primary wheels 130*b*.

The motorized walking platforms 102 further comprises a control circuitry 154, configured to control at least the functionality of the motor 140, and optionally additional components of the motorized walking platforms 102. The control circuitry 154 can be coupled to the motor 140 and other components of the motorized walking platforms 102 via at least one transmission line 160, configured to deliver signals between the control circuitry 154 and such components. The at least one transmission line 160 may be further configured to deliver power, originating from a power source 184, to energize the electric components of the motorized walking enhancement platforms 102.

According to some embodiments, the control circuitry 154 comprises a processor (not shown), which may be configured for processing and interpreting sensed signals received various sensors as further elaborated below, and configured to control various functionalities of components of the motorized walking enhancement platforms 102, via the control circuitry 154. According to some embodiments, the processor may include software for interpreting sensed signals.

According to some embodiments, the motorized walking platforms 102 further comprises a communication unit 156, which comprises a wireless communication component such as a transmitter, a receiver, and/or a transceiver, configured to wirelessly transmit signals to, and/or receive signals from, the remote-control device 60.

can be a wireless communication unit 156, configured to wirelessly communicate with a remote-control device 60. The communication unit 156 may be provided as an integral part of the control circuitry 154, or as a separate component in communication with the control circuitry 154, for example via at least one transmission line 160.

According to some embodiments, the motorized walking platforms 102 further comprises an ergonomic rear extension 116, which may be formed as a rigid curved vertical extension, extending upward from the rear frame portion 112, configured to provide adequate support to the backside of the shoe and the user's foot. The ankle strap 120 may extend from the read extension 116.

According to some embodiments, the motorized walking platforms 102 further comprises an ergonomic leg brace 186, which may be coupled to a user's leg via the shin/calf strap 188, and may house a power source 184 therein (see FIG. 4A), such as a battery or a plurality of batteries. The battery 184 can be a rechargeable battery, and can be coupled to electrical components of the motorized walking platforms 102, such as the control circuitry 154, the motor 140 etc., via a power transmission cable 158. In some embodiments, the power source 184 can include a plurality of batteries. According to some embodiments, the power source 184 can include replaceable batteries.

In some implementations, the power transmission cable 158 may extend through the rear extension 116, in which case the rear extension 116 can further serve to support and guide the lower portion of the power transmission cable 158.

Distancing the power source 184 away from the base frame 104, such as by placing it in a leg brace 186 secured to the shin/calf of the user, advantageously enables reduction of the overall weight carried by the walker's foot. The distribution of weight of each motorized walking enhancement platform 102, and the reduced weight carried by, or coupled to, the respective base frame 104, provides for more natural and agile user movement and improves stability.

While the control circuitry 154 and/or the communication unit 156 are illustrated throughout the figures attached to the base frame 104, alternative configurations are contemplated, in which either the control circuitry 154 and/or the communication unit 156 may be comprised within the leg brace 186. In such configurations, the transmission cable 158 may serve not only as a power transmission cable, but also as a unidirectional or bi-directional signal transmission line.

As mentioned herein above, the functionality of the mobility enhancement system 100 can be controlled by a remote-control device 60, which can be a handheld device utilized to wirelessly communicate with the communication unit 156. An exemplary remote-control device 60 may be provided as a dedicated hand-held or hand-wearable device for communicating with the communication unit 156, or as a commercially available mobile device such as a smartphone, a tablet, a smart watch and the like, which may include software commands for communicating with the communication unit 156.

The remote-control device 60 includes at least one wireless communication component (not shown) such as a transmitter, a receiver, and/or a transceiver, configured to wirelessly transmit signals to, and/or receive signals from, the communication unit 156.

According to some embodiments, the communication unit 156 and/or the remote-control device 60, are configured to transmit and/or receive signals to and/or from each other using one or more communication protocols such as Bluetooth, RF, LORA, Zigbee, Z-Wave, Near Field Communication (NFC), or the like.

According to some embodiments, the remote-control device 60 further comprises an input interface 61, such as buttons, sliders, a keyboard, an on-screen keyboard, a keypad, a touchpad, a touch-screen and the like. The input interface 61enables the user to turn on or off the motorized walking enhancement platforms 102, as well as to optionally set various personal attributes such as desired rolling speed and the like.

Commands from the remote-control device 60 may be simultaneously transmitted in real-time to both motorized walking enhancement platforms 102, for example—received by a communication unit 156 of each of the walking enhancement platforms 102, which may in turn translate to signals sent by the corresponding control circuitries 154 of both platforms 102, to facilitate rotation of the primary wheels 130 of both platforms 102 at the same speed.

According to some embodiments, the remote-control device 60 may allow a user to set various commands to operate and control the motorized walking enhancement platforms 102, such as turning on or off, setting up the desired rolling speed, the rates of acceleration and/or deceleration, and the like. Preferably, the remote-control device 60 may be operated in a simplified manner without requiring the user to look at it during operation thereof. Moreover, the user is not required to further manipulate or hold the remote-control device 60 during walking, as long as no further change in parameters is desired.

According to some embodiments, the remote-control device 60 further comprises a display (not shown), serving as a visual interface configured to display information which may include, for example, alerts, recommendations, and the like. An application of a remote-control device 60 (e.g., a smartphone app) can include additional features to improve user's experience, such as navigation assistance, route planning, and integration with urban transport services. The application can further provide battery level indication and real-time speed display functionalities.

The connectivity of the motor 140, via the drive line 136, to both lateral sub-assemblies 126 via the non-differential transmission mechanisms 148, ensures that the entire drive assembly 124 acts as a single uniform drive-train configured to rotate all primary wheels 130 at the same uniform speed. The non-differential transmission mechanisms 148 ensure that the primary wheels 130 are configured to move only in the longitudinal direction, thereby simplifying the structure of the motorized walking enhancement platform 102 and potentially reducing the overall weight thereof.

While the motorized walking enhancement platform 102 described herein, includes two lateral sub-assemblies 126, each provided with a couple of primary wheels 130, other implementations may include more than two couples of primary wheels 130, as long as the motor 140 is coupled, directly or indirectly, to all of the lateral sub-assemblies 126, and is configured to drive all of the primary wheels 130 in unison at the same speed.

Thus, any change in rotational speed of any one of the lateral sub-assemblies 126 is immediately reflected to the other lateral sub-assembly 126 via the drive assembly 124. The control circuitry 154 is configured to detect any change in the rotational speed of any component of the drive assembly 124, such as any one of the lateral sub-assemblies 126, the longitudinal shaft members 146 and/or the motor shaft 142. Once such deviation in the rotational speed is detected, the control circuitry 154 is further configured to provide appropriate signals to the motor 140 so as to counter the detected change and ensure that the drive assembly 124 reverts back to the desired rotational speed. In this manner, the revolving speed of all primary wheels 130 of each platform 102 is controlled to remain constant and uniform between both platforms 102, such that the walker's longitudinal balance is maintained, as if walking on a stable planar surface that travels in constant speed relative to the ground in the direction of walking. The control circuitry 154 can increase or decrease the amount of power supplied to the motor 140, which may affect the speed at which the primary wheels 130 of the motorized walking platform 102 rotate.

According to some embodiments, the drive assembly 124 comprises at least one rotation speed sensor 190, configured to continuously measure the rotational speed on at least one component of the drive assembly 124.

According to some embodiments, at least one rotation speed sensor 190 is coupled to the drive line 136. According to some embodiments, at least one rotation speed sensor 190 is coupled to the motor shaft 142, such as the rotation speed sensors 190*a* illustrated on both sides of the motor 140 illustrated in FIG. 2A. While two rotation speed sensors 190*a* are illustrated, mounted over or otherwise attached to the motor shaft 142 on both sides of the motor 140, it will be clear that a single rotation speed sensors 190*a* may suffice. Nevertheless, in some implementations, providing more than a single rotation speed sensor may be beneficial for purpose of redundancy.

While not specifically illustrated, other rotating components of the drive line 136 may include at least one rotation speed sensor 190, instead of or in addition to the rotation speed sensor 190*a* of the motor shaft 142. For example, in some embodiments, at least one rotation speed sensor 190 can be mounted over or otherwise attached to at least one longitudinal shaft member 146, such as the front longitudinal shaft member 146*a* or the rear longitudinal shaft member 146*b*. Moreover, while the rotation speed sensors 190*a* are shown in FIG. 2 to be mounted over or otherwise attached to the portions of the motor shaft 142 protruding from the motor 140, in some embodiment, at least one rotation speed sensor 190 can be encompassed within the motor 140, for example by being mounted over or otherwise attached to a portion of the motor shaft 142 extending through the motor 140.

According to some embodiments, at least one lateral sub-assembly 126 comprises at least one rotation speed sensor 190. According to some embodiments, at least one rotation speed sensor 190 is mounted on or otherwise attached to at least one axle, such as the rotation speed sensors 190*b* illustrated on both sides of the front axle 132*a* and the rear axle 132*b* in FIG. 2A.

It will be clear that two rotation speed sensors 190*a* and four rotation speed sensors 190*b* are shown in FIG. 2A together for purpose of illustration only, and that in most cases, a single or a couple of rotation speed sensors 190 may suffice. In fact, since any change in the rotational speed of any component of the drive assembly 124 is reflected on any other component of the drive assembly 124, it may be sufficient to place a rotation speed sensor 190 over or attached to any rotating component of the drive assembly 124. Nevertheless, a combination of more than one rotation speed sensor 190 may be desired for redundancy.

The at least one rotation speed sensor 190 is electronically coupled to the control circuitry 154, for example via at least one transmission line 160, and is configured to generate a signal commensurate with the rotation speed of the component it is coupled to, which in turn is commensurate with the rotation speed of the primary wheels 130. According to some embodiments, the at least one rotation speed sensor 190 comprises an absolute encoder or an incremental encoder. According to some embodiments, the at least one rotation speed sensor 190 comprises an optical encoder. According to some embodiments, the at least one rotation speed sensor 190 comprises a mechanical encoder. According to some embodiments, the at least one rotation speed sensor 190 comprises a magnetic encoder. According to some embodiments, the at least one rotation speed sensor 190 comprises a capacitance encoder.

In use, the at least one rotation speed sensor 190 provides feedback corresponding to the actual momentary rotation speed of the primary wheels 130 to the control circuitry 154. The control circuitry 154 is configured to compare the actual momentary speed to a predefined threshold, that can be set by the remote-control device 60. If the actual measure rotational speed is either lower or higher than the predefined threshold, corresponding to the desired pre-set rotation speed, the control circuitry 154 provides controlling signals configured to readjust the motor's 140 rotation torque, to revert the rotation speed of the primary wheels 130 back to the pre-set desired speed. Readjustment of the motor's 140 speed include the ability of the control circuitry to either accelerate or decelerate the motor. Preferably, the momentary speed is sensed by the at least one rotation speed sensor 190 and neutralized by the control circuitry 154 via the motor 140 at a frequency which is sufficiently fast, so that the rotational motion of the primary wheels 130 is readjusted on the fly in a manner which is transparent to the walker, thereby ensuring that the walker's longitudinal balance is maintained at all times.

According to some embodiments, the time period including the steps of acquiring signals from the at least one speed sensor 190, and counterbalancing the rotation torque of the motor 140 by the control circuitry 154 so as to counter any potential change on the rolling speed of the primary wheels 130, is equal to or lower than 0.05 seconds. According to some embodiments, the time period including the steps of acquiring signals from the at least one speed sensor 190, and counterbalancing the rotation torque of the motor 140 by the control circuitry 154 so as to counter any potential change on the rolling speed of the primary wheels 130, is equal to or lower than 0.01 seconds.

According to some embodiments, the motorized walking enhancement platform 102 further comprises a pair of secondary wheels 162. Each secondary wheel 162 is coupled to the base frame 104 by a lever 164, wherein the vertical position of each secondary wheel 162 relative to the base frame 104 is displaceable via a lever height regulator 170, as shown in FIG. 2E.

The term "vertical", as used herein, refers to a direction which is substantially orthogonal to the surface defined by the base frame 104, such as the upper frame surface 106 or the lower frame surface 108. Otherwise stated, the term "vertical" refers to a direction orthogonal both to the longitudinal axis 138 and the lateral axes 128.

The lever 164, may be provided as a rigid pivotable arm, attached to the secondary wheel 162 at a lever free end, and to the base frame 104 at lever hinged end 166. In some embodiments, the lever hinged end 166 can be hinged, for example to the lower frame surface 108, via hinge 180, which can be an H-hinge as illustrated in FIG. 2E, or any other type of hinge configured to enable the lever 164 to pivot about its lever hinged end 166.

Figure 2E:
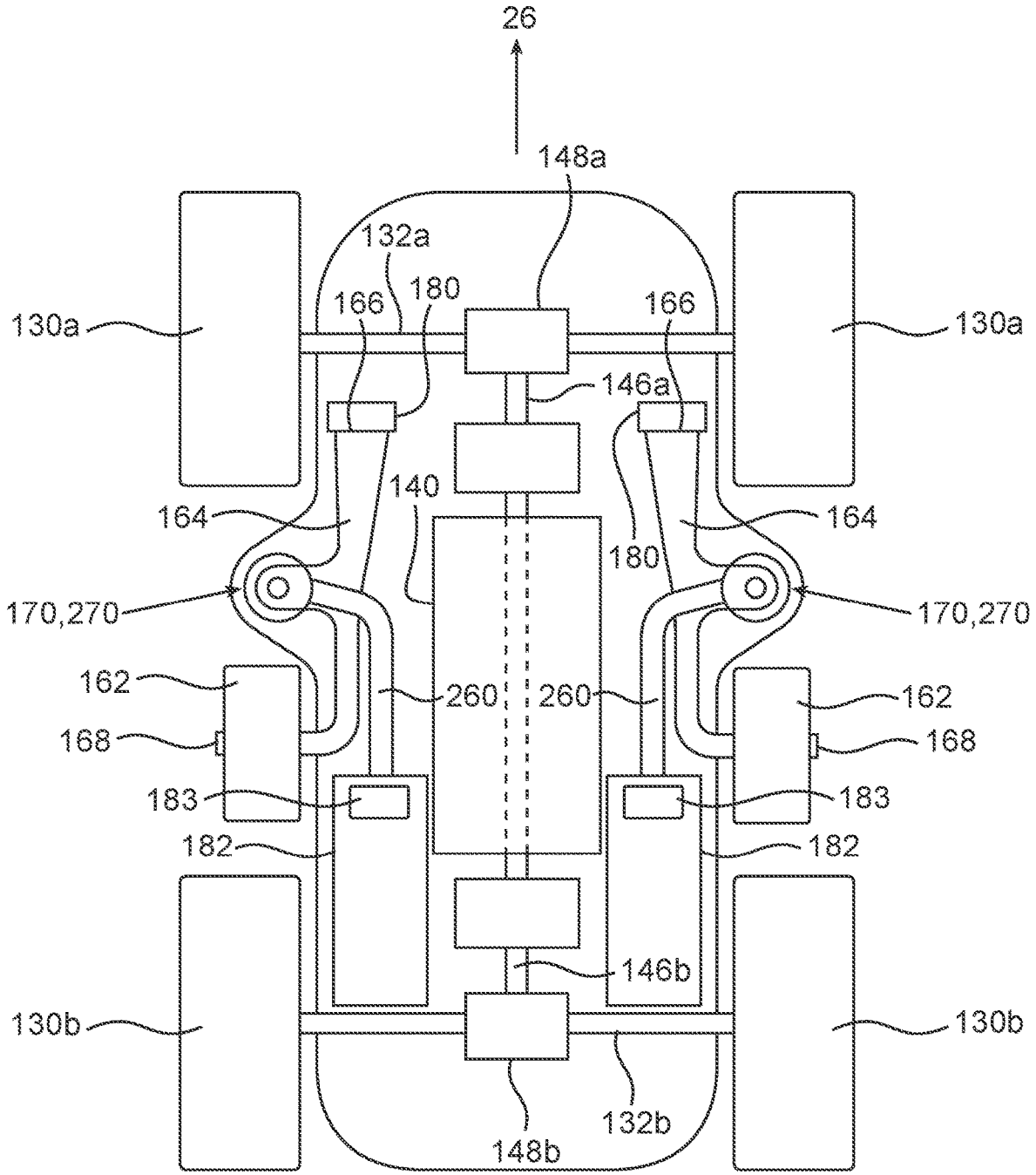
FIG. 2E shows a schematic plan view of a motorized walking enhancement platform with a pneumatic/hydraulic lever height regulator, according to some embodiments.

According to some embodiments, the lever free end 168 may be L-shaped, as illustrated in FIG. 2E, to extend sideways away from the edge of the base frame 104, so as to offset the secondary wheel 162 attached thereto away from the side-edge of the base frame 104. This may ensure that the secondary wheels 164 do not contact the frame 104, for example while being dispositioned vertically.

According to some embodiments, the lever height regulator 170 may be attached to base from 104 at a height regulator upper connection point 176, and to the lever 164 at a height regulator lower end 178. While the position of the height regulator upper connection point 176 remains immovable relative to the frame base 104 at all times, the vertical position of the height regulator lower end 178 may change relative to the height regulator upper connection point 176. Since the secondary wheel 162 is attached to the lever free end 168, and since the lever 164 is attached in turn to the lever height regulator 170, any change in the vertical position of the height regulator lower end 178 translates to a pivotable movement of the lever 164 about the lever hinged end 166, which in turn translates to vertical displacement of the secondary wheel 162.

According to some embodiments, the lever height regulator 170 comprises a pneumatic/hydraulic drive unit 270, as shown in FIGS. 4A-4B. The pneumatic/hydraulic drive unit 270 can include a pneumatic/hydraulic piston 274 vertically movable through a pneumatic/hydraulic cylinder 272. The pneumatic/hydraulic cylinder 272 may be attached to the base frame 104 at the pneumatic/hydraulic cylinder connection point 276, which is the equivalent of the height regulator upper connection point 176, while the pneumatic/hydraulic piston may be connected to the lever 164 at the pneumatic/hydraulic piston lower end 278, which is the equivalent of the height regulator lower end 178.

The term "pneumatic/hydraulic", as used herein for any component or system, means that the component or system can be implemented either as pneumatic/hydraulic component or system.

In some embodiments, the motorized walking enhancement platform 102 further comprises a pair of actuators 182, wherein each actuator 182, which can be a pneumatic/hydraulic actuator, is coupled to a corresponding lever height regulator 170, for example via a pneumatic/hydraulic lever transmission line 260, and is configured to control the vertical position of the height regulator lower end 178. Each actuator 182 can be controllably coupled, for example via a pneumatic/hydraulic transmission lines 270, to a corresponding lever height regulator 170, such as a pneumatic/hydraulic drive unit 270. In some embodiments, each actuator 182 can further include an actuator sub-controller 183, configured to control the operation of the actuator 182, for example by diverting the appropriate amount of a pneumatic/hydraulic fluid for operating hydraulic/pneumatic pistons attached to the actuator 182. The pneumatic/hydraulic lever transmission line 260 may serve as a conduit to transmitting pneumatic/hydraulic fluid to and from the pneumatic/hydraulic drive unit 270.

The control circuitry 154 may be controllably coupled to the actuator 182, for example via transmission lines 160, to control the functionality of the actuators 182, potentially in communication with the actuator sub-controller 183, thereby controlling the vertical position of the secondary wheels 162.

According to some embodiments, the motorized walking enhancement platform 102 may further comprise a pair of side extensions 114 extending upward from the base frame 104. The side extensions 114 can be either integrally formed with the base frame 104, or separately formed and affixed to the sides of the base from 104. In some embodiments, the side extensions 114 may be aligned with the foot strap 118, such that the lateral strap section 117 may extend therefrom. In some embodiments, the side extensions 114 may be aligned with the lever height regulators 170, and may include opening through which the lever height regulators 170, such as the pneumatic/hydraulic drive units 270, may extend—thereby protecting them from external obstacles.

According to some embodiments, the pneumatic/hydraulic drive unit 270 is retained in a retracted state (shown in FIG. 4A) while the motorized walking enhancement platform 102 is not in contact with the ground 20, and is configured to move the secondary wheels 162 downward to a lowered state (shown in FIG. 4B) when the motorized walking enhancement platform 102 contacts the ground, bringing the secondary wheels 162 in contact with the ground 20 in this state.

According to some embodiments, the primary wheels 130 are disposed on both sides of the base frame 104, having a diameter large enough to extend at their uppermost edges upward relative to the upper frame surface 106. Advantageously, this configuration provides a lower and wider foothold, thereby enhancing lateral stability of the motorized walking enhancement platform 102 over the ground 20. According to some embodiments, the diameter of the secondary wheels 162 is smaller than the diameter of the primary wheels 130.

According to some embodiments, the motorized walking enhancement platform 102 further comprises at least one pressure sensor 192. According to some embodiments, the front lateral sub-assembly 126*a* comprises at least one front pressure sensor 192*a*, and the read lateral sub-assembly 126*b* comprises at least one rear pressure sensor 192*b*. FIG. 2A shows an exemplary configuration of two front pressure sensors 192*a* coupled to both sides of the front axle132*a* or to both front primary wheels 130*a*, and two rear pressure sensors 192*b* coupled to both sides of the rear axle132*b* or to both rear primary wheels 130*b*. It will be clear that other configurations are contemplated, such as a single front pressure sensor 192*a* coupled to other portions of the front axle 132*a* or a component of the front non-differential transmission mechanism 148*a*, and a single rear pressure sensor 192*b* coupled to other portions of the rear axle 132*b* or a component of the rear non-differential transmission mechanism 148*b*.

The pressure sensor 192 are electrically coupled to the control circuitry 154, for example via transmission line 160, and deliver signals indicating whether the rear primary wheels 130*b* and/or front primary wheels 130*a* are in contact with the ground, and/or when they are leaving the ground.

The power source 184 can be used to power at least one component of the motorized walking platforms 102, such as the control circuitry 154, the motor 140, the communication unit 156, the at least one rotation speed sensor 190, the at least one pressure sensor 192, and/or the actuators 182.

The term "and/or" is inclusive here, meaning "and" as well as "or". For example, "component A and/or component B" encompasses, component A, component b, and component A with component B; and, such "component A and/or component B" may include other elements as well.

According to some embodiments, the secondary wheels 162 comprise an outer layer which is softer than that of the primary wheels 130, thereby acting as a cushion to absorb some of the impacts during walking motion.

In some cases, forward or backward excessive skid forces may be applied at the forward positioning of the leading foot on the ground, for example as the sole strikes the ground following the heel strike, or as the heel rises while the sole is still in contact with the ground. Such excessive skid forces may require excessive motor torques that are prohibitive, given the pivotal weight limit of the motorized walking enhancement platform 102.

According to some embodiments, the motorized walking enhancement platform 102 further comprises a pneumatic/hydraulic braking system 194 (see FIG. 2D), configured to assist in neutralizing the skid forces by the front wheels 130*a* when the skid forces 32 are higher than a predefined upper threshold.

The braking system 194 includes a pneumatic/hydraulic braking unit 196 attached to each of the front primary wheels 130*a*. The pneumatic/hydraulic actuator 182 can be coupled to the pneumatic/hydraulic braking unit 196 via pneumatic/hydraulic braking transmission line 260, which may serve as a conduit to transmitting pneumatic/hydraulic fluid to and from the pneumatic/hydraulic drive unit 270.

The pneumatic/hydraulic braking unit 196 is configured to apply counter friction forces on the front wheels 130*a*, so as to alleviate the extra torque burden from the motor 140. Advantageously, the same pneumatic/hydraulic actuator 182 is shared by both the pneumatic/hydraulic drive unit 270 and the pneumatic/hydraulic braking unit 196. The actuator sub-controller 183 may be further utilized to readjust the amount of pneumatic/hydraulic fluid flowing through each of the lever transmission line 260 and the braking transmission line 261, so as to control the functionality of each of the pneumatic/hydraulic drive unit 270 and the pneumatic/hydraulic braking unit 196 as required.

Reference is now made to FIGS. 6A-6E, schematically showing the longitudinal forces acting between the primary wheels 130 on the ground 20 during different phases of a stride or gait cycle. The net forward force 30 schematically represents the forward driving force applied by the primary wheels 130 on the ground 20 so as to advance the platform 102 forward. In a forward walking action shown in FIG. 6A, the rear primary wheels 130*b* strike the underlying ground 20, which may result in forward skid forces 32 materializing between the rear primary wheels 130*b* and the ground 20. These skid forces, which affect the rolling speed of the rear primary wheels 132*b* (and consequently, any other rotatable component of the drive assembly 124), are immediately sensed by the at least one rotation speed sensor 190. The signals are delivered to the control circuitry 154, which readjusts the rotation of the motor 140 so as to apply a reaction force 34 equal to the skid force 32 in an opposite direction, thereby neutralizing it so that the net forward force remains unchanged, at a frequency high enough so as to avoid any disturbance that can be felt by the walker.

Figure 6A:
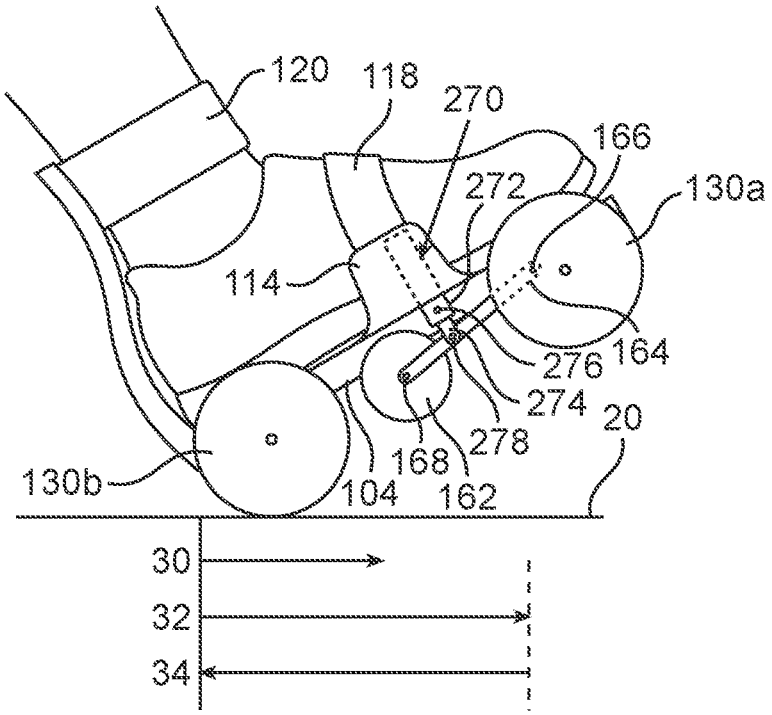
FIGS. 6A-6E schematically show a motorized walking enhancement platform with a pneumatic/hydraulic drive unit, during different phases of a stride or gait cycle, according to some embodiments.

At the phase shown in FIG. 6A, the pneumatic/hydraulic drive unit 270 is shown in the retracted state prior to and during first contact of the rear primary wheels 130*b* with the ground. The at least one read pressure sensor 192*b* delivers signals, indicative of the elevated pressure applied thereto by the sole of the foot pressing against the ground 20, to the control circuitry 154, which in turn controls the actuators 182 to lower the pneumatic/hydraulic piston 274 and the secondary wheels 162 there-along, to the lowered state shown in FIG. 6B, during which the secondary wheels 162 may contact the ground 20. The lever height regulators 170 provide consistent mild force that may support the foot's sole, and absorb shock as the secondary wheels 162 are being positioned on the ground 20. Moreover, the rear primary wheels 130*b*, along with the secondary wheels 162, together form a rectangular-like support base on the ground, thereby improving stability of the motorized walking enhancement platform 102 during the heel-strike phase of the gait cycle.

Figure 6B:
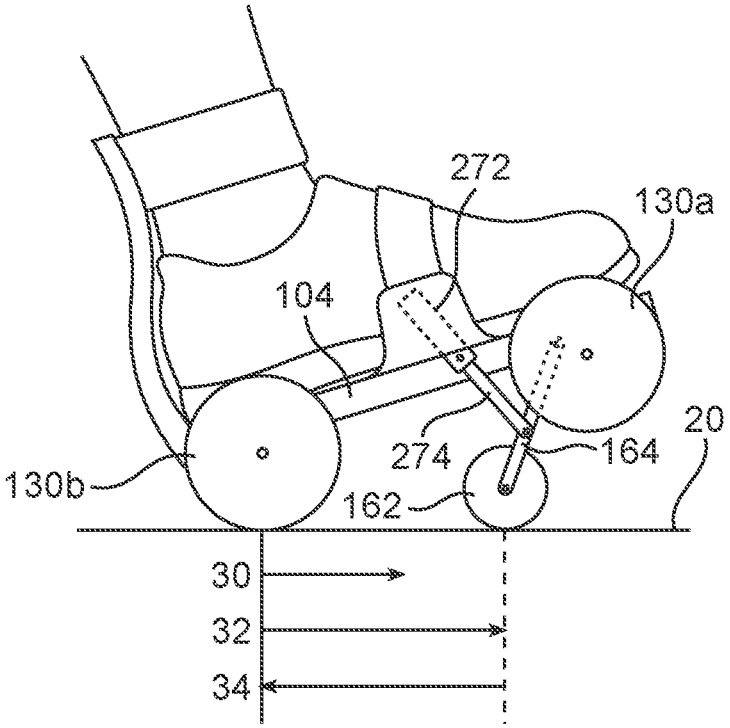
Figure 6C:
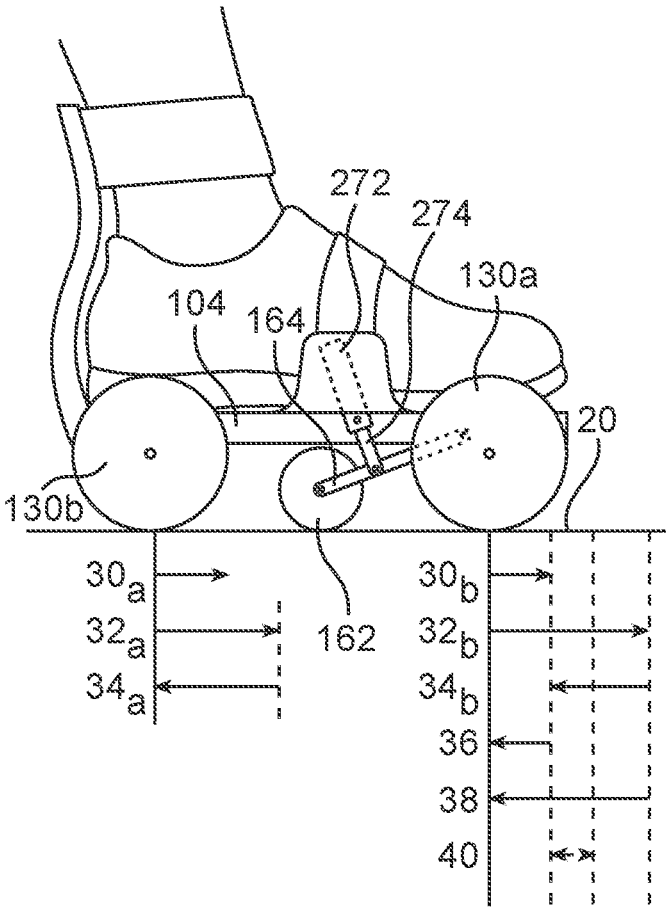

As the front portion of the foot is also lowered in FIG. 6B, the front primary wheels also land on the ground 20, such that all of the primary wheels 130 are laid on and roll over the ground 20 in in the mid-stance phase shown in FIG. 6C. Skid forces 32*a* and 32*b* may be applied by either the front and rear primary wheels 130*a* and 130*b*, respectively. The forces are similarly sensed by the front and rear rotation speed sensor 190*a* and 190*b*, and may in turn be fully or partially neutralized by the front and rear motor reaction forces 34*a* and 34*b*. As shown, the front skid force 32*b* may be significantly higher than the rear skid force 32*a*, and in excess of a predetermined upper threshold. In such a case, the braking system 194 also applies a braking system counter force 36, which together with the motor reaction force 34*b*, result in a total neutralizing force 38 which is opposite in direction and equal in magnitude to the front skid force 32*b* such that the net forward force 30*b* remains constant.

As the front primary wheels 130*a* are also lowered to contact the ground 20, as shown in FIG. 6C, the lever 164 may pivot upward to some extent, enabling the secondary wheels 162 to retain full contact with the ground 20, so that all of the primary and secondary wheels 130 and 162, respectively, may contact the ground 20 and roll forward. While the primary wheels 130 are actively rotated by the motor 140, the secondary wheels passively roll over the ground there-between.

The weight of the walker during the positioning of the sole on the ground at the beginning of a step is the source of pneumatic/hydraulic power to operate both the pneumatic/hydraulic drive unit 270 and the pneumatic/hydraulic braking unit 196. For example, 12 kg of the walker's weight may be sufficient to store the required pneumatic/hydraulic power.

In some embodiments, the motor 140 is further configured to provide sensitive fluctuations' counter-force 40, for example, via a sensitive motor bracket (not shown), to counter the fluctuations that may originate from the relatively crude braking system 194.

The control circuitry 154 is configured to activate the braking system 194 according to logic and parameters derived from the signals readings of the rotation speed sensors 190 and the activated counter torques values (i.e., the motor reaction forces 32), calculating and timing and progressive pace of application of hydraulic power to the pneumatic/hydraulic braking units 194 at the front wheels 130*a*.

Figure 6D:
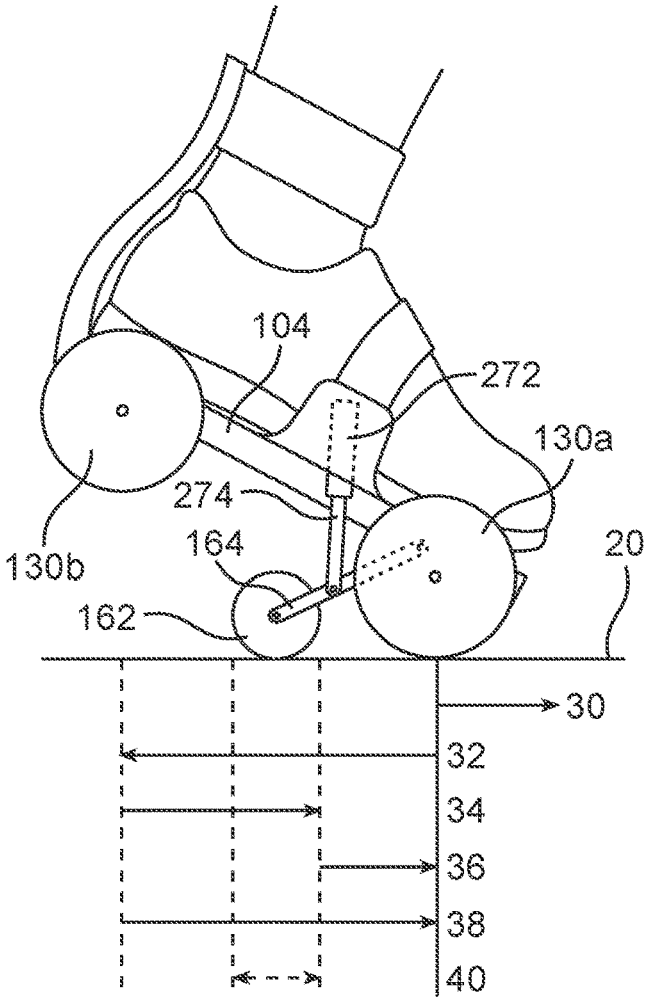

During the push-off phase of the gait cycle shown in FIG. 6D, the rear primary wheels 130*b* are lifted up from the ground 20 as the motorized walking enhancement platform 102 starts breaking contact with the ground, while the front primary wheels 130*a* are still in contact with the ground 20, resulting in rearward skid forces 32 materializing between the front primary wheels 130*a* and the ground 20. The secondary wheels 162 may remain in a downward state (i.e., in contact with the ground 20) while the front primary wheels 130*a* are still pressed against the ground 20. The front primary wheels 130*a*, along with the secondary wheels 162, together form a rectangular-like support base on the ground, thereby improving stability of the motorized walking enhancement platform 102 during the heel-lift off phase of the gait cycle.

The pneumatic/hydraulic drive units 270 may discharge the accumulated energy therein, so as to produce adjustable assisting lifting force that may further support forward thrust motion at the end of the step. This assisting force may help in reduction and regulation of the counter torque, in terms of amplitude and/or volatility, which is applied to the motor shaft 142 by the foot's rolling motion, during positioning of the leading foot on the ground (FIGS. 6A-6B) and during the forward thrust motion (FIG. 6D). Specifically, the assisting force may reduce the maximum torque requirement from the motor 140, thereby enabling overall weight reduction.

As shown, the skid force 32 once again may surpass the predetermined upper threshold, in which case the braking system 194 will again apply a braking system counter force 36, which together with the motor reaction force 34, results in a neutralizing force 38 opposite in direction and equal in magnitude to the front skid force 32 such that the net forward force 30 remains constant, while the motor fluctuations' counter-force 40 may alleviate the fluctuations that may arise from the relatively crude braking system 194.

Figure 6E:
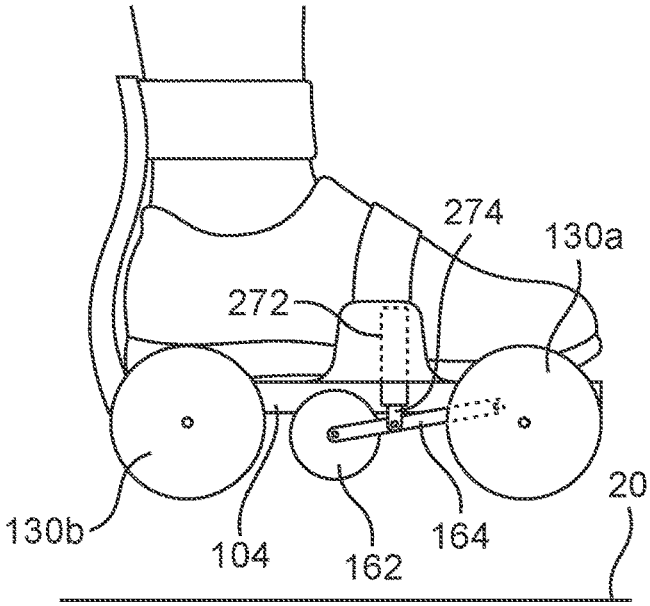

FIG. 6E shows the foot in the air, while both pairs of primary wheels 130 are raised above the ground 20. In this state, there is an immediate drop of load on the airborne lateral sub-assemblies 126, and the control circuitry 154 is configured to immediately readjust the torque produced by the motor 140 to a minimal value, keeping all of the airborne primary wheels 130 rolling forward in unison at a constant speed, while none of them exerts any forces on the ground 20. In this state, both the front and rear pressure sensors 192*a* and 192*b*, respectively, indicate this state and the control circuitry 154 activates the actuators 182 to raise the secondary wheels 162, via the pneumatic/hydraulic drive units 270, to the retracted state.

The term "skid force", as used herein, refers to a component force parallel to the ground 20 of the force transmitted to each motorized walking enhancement platform 102 by the walker's leg, which can be in a forward direction during the strike of the heel as shown 6A-6B, and backward during the final phase of the step, as shown in FIG. 6D. The skid force can vary due to a number of factors, such as wind, random body movements, and the like. The component of the force which is perpendicular to the ground 20 is cancelled by the reaction of the ground, while the skidding force 32 is compensated by artificially created opposite reaction force 34.

The drive assembly 124, including a longitudinal-centric motor 140, with two speed reduction units 144*a*, 144*b* mounted on both sides of the motor 140, and two non-differential transmission mechanisms 148*a*, 148*b* configured to transmit power from the longitudinally oriented drive line 136 to the front and the rear transverse driving axles 132*a* and 132*b*, respectively, can automatically allocate all torque produced between both axles 132*a* and 132*b* according to their instantaneous load demand along the full step or gait cycle. For example, all torque may be allocated to the front primary wheels 130*a* during the forward thrust motion (see FIG. 6D), all torque can be allocated to the rear primary wheels 132*b* during the heel strike instant (see FIG. 6A), and all torque can be allocated to all primary wheels 132 according to an adaptive ratio during the backwards movement of the platform with all primary wheels 132 on the ground (see FIG. 6C).

When compared to other walking propulsion solutions known in the art, the above-mentioned configuration advantageously offers the most effective and efficient locomotive solution for motorized-assisted walking with the minimal weight possible. For example, other previously disclosed platform propulsion configurations that tie different motors, gears and torque transmission components, with a partial number of wheels, cannot be as effective and efficient as the currently disclosed configuration, as when all of the maximal torque produced by the motor needs to be allocated only to the front wheels during the forward thrust motion, previously disclosed configurations render mute the motors that are idled because they are coupled only to the rear wheels, or they may otherwise not couple directly or in a most-efficient manner also to the front wheels. Such inferior configurations render the idled motors and all relating power-transmission modules that are not propelling the wheels that touch the ground in each step, a wasted and unused weight. The currently disclosed configuration, on the other hand, provides a single propulsion unit—in the form of drive assembly 124, configured to both produce and deliver, through all of the transmitting components such as speed reduction units 144 and non-differential transmission mechanisms 148, the maximal torque possible per unit weight and per platform dimensions, and allocate all of the torque in high fidelity and maximum mechanical efficiency to the front or to the rear primary wheels 130*a*, 130*b*, or to both, as is required at each instant of the step or gait cycle.

The mobility enhancement system 100 is dimensioned to be utilized over a ground 20 having a relatively low slope, but able to overcome height inconsistencies and random obstacles having a vertical height of about up to 1.5 cm, and allow for bridging planar gaps in the pavement surface of about 2.5 cm in width.

Advantageously, all of the primary wheels 130 are configured to roll only along a longitudinal direction, thereby simplifying the structure and minimizing the weight of the mobility enhancement system 100, not requiring any complementary components or mechanisms for lateral movement thereof.

The contact angle and the skid forces between the foot and the ground 20 in forward walking motion varies from step to step due to a number of factors, such as the gait phase, the profile of the terrain, the behavior of the walker and so on. The current mechanism ensures that regardless of such factors, the influence of the skid forces 32 on the rotation speed of the primary wheels 130 is measured at any moment and countered by reactions forces 34 so as to maintain a constant rolling speed.

Advantageously, the lowered state of the lever height regulators 170 enables the secondary wheels 162 to be in contact with the ground along with the rear primary wheels 130*b* and/or the front primary wheels 130*a*, so that a minimum of four contact points with the ground 20 is maintained also during lowering or raising the foot toward or away from the ground 20, thereby significantly enhancing platform 102 stability in these stages of the gait cycle.

Retaining the secondary wheels 162 in a retracted state when the foot is in the air, may advantageously protect them from tangling with other potential environmental obstacles.

Advantageously, the braking system 194 based on a self-energizing pneumatic/hydraulic system, is of significantly superior power to weight ratio relative to that of the electric motor 140, and can be offset to significant extent in terms of absolute weight burden on the entire motorized walking enhancement platform 102. Furthermore, the reduced output torque requirement from the drive assembly 124 may provide additional meaningful advantages, such as improved durability and resiliency of the drive assembly 124, reduced drive assembly 124 dimensions that allow the primary wheels 130 to be provided with smaller diameters, thereby lowering the height of the walker's feet above the ground so as to improve the walker's stability, on top of enabling further reduction in the motorized walking enhancement platform's 102 weight.

Figure 5:
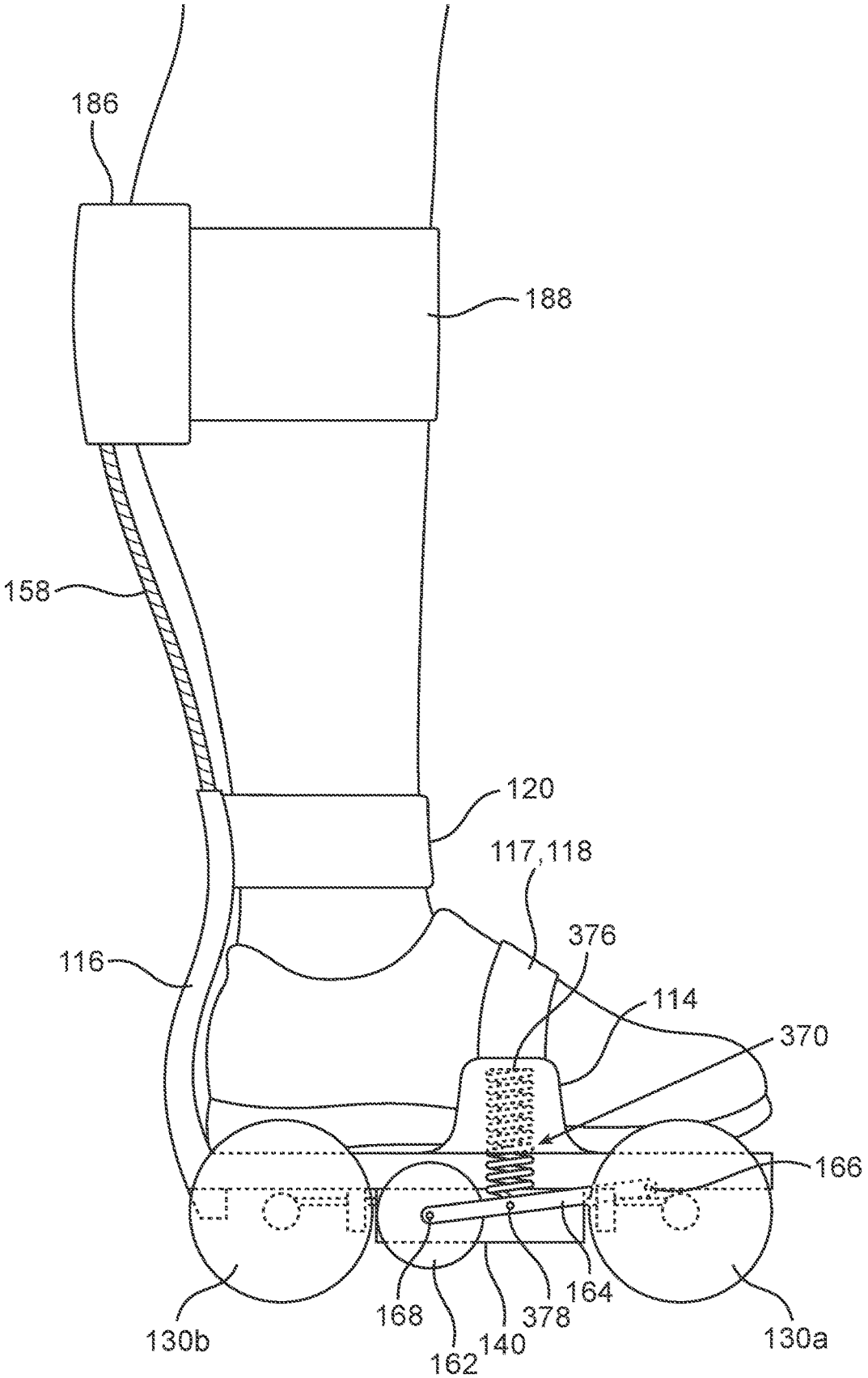
FIG. 5 shows a side view of a motorized walking enhancement platform with a spring-type lever height regulator, according to some embodiments.

Reference is now made to FIG. 5, showing a side view of a motorized walking enhancement platform 102 with a spring-type lever height regulator 370. According to some embodiments, the lever height regulator 170 comprises a spring 370. The spring 370 may be attached to the base frame 104 at the spring upper connection point 376, which is the equivalent of the height regulator upper connection point 176, and connected to the lever 164 at spring lower end 378, which is the equivalent of the height regulator lower end 178.

It will be understood that any type of a lever height regulator 170 may be connected at the height regulator upper connection point 176 direction to the base frame 104, or indirectly via attachment to another component affixed to the base frame 104, such as the side extension 114.

According to some embodiments, a lever height regulator 170, such as the spring 370, may be displaceable from a free state, in which it may be biased downward (i.e., toward the ground 20), such that the secondary wheels 162 may be positioned vertically lower than the lowermost edge of the primary wheels 130, and a pressed state, wherein the lever height regulator 170 moves vertically upward, pressing the secondary wheels 162 to full contact with the ground 20.

Figure 7A:
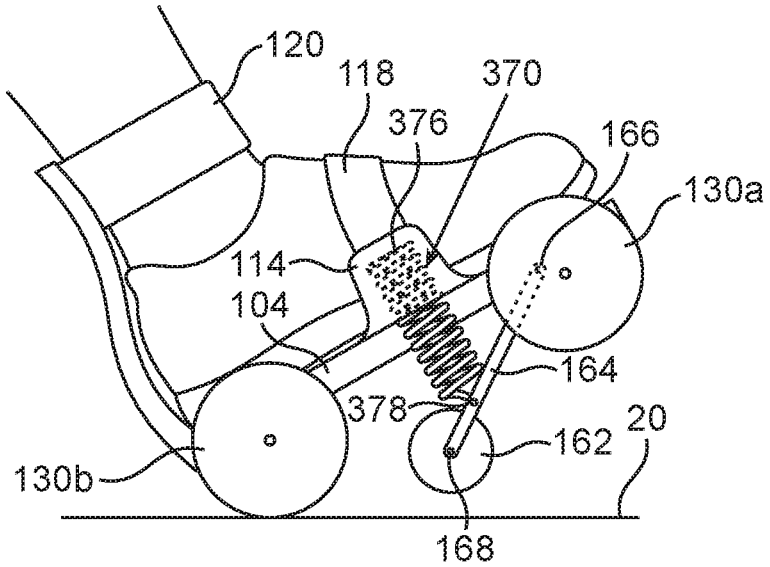
FIGS. 7A-7E schematically show a motorized walking enhancement platform with a spring-type lever height regulator, during different phases of a stride or gait cycle, according to some embodiments.
Figure 7B:
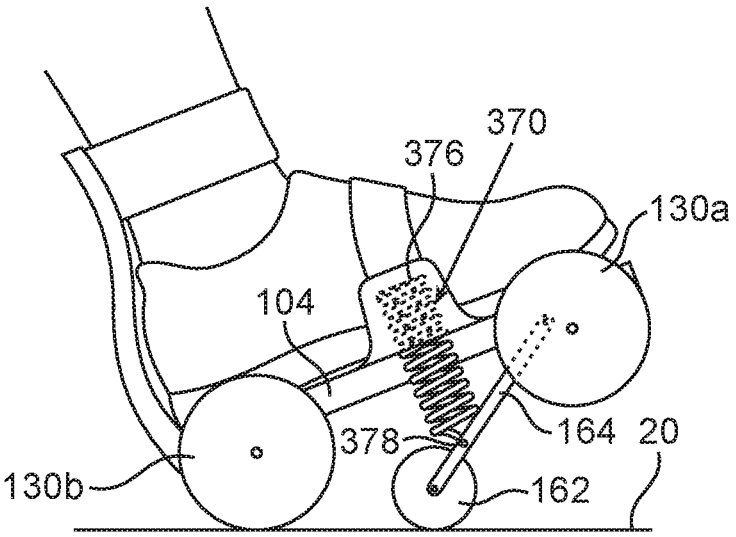
Figure 7C:
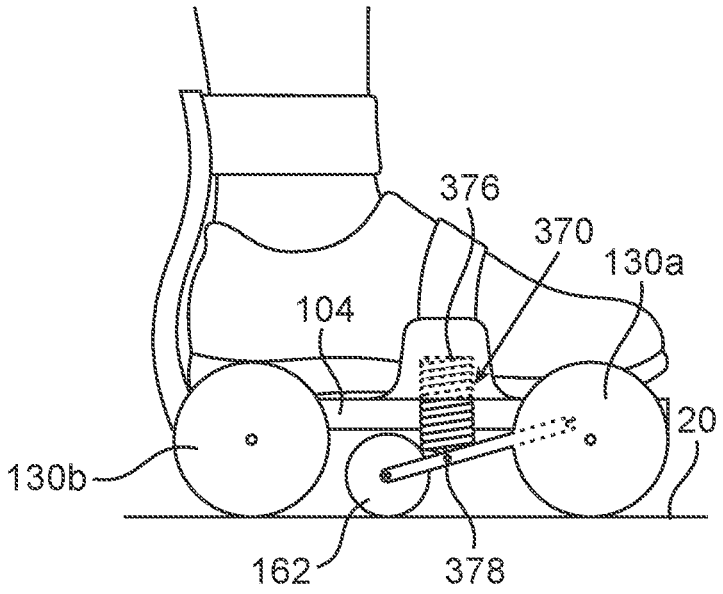

Reference is now made to FIGS. 7A-7E, showing different states of a motorized walking enhancement platform 102 equipped with a spring 370 in different phases of a stride or gait cycle. At the phase shown in FIG. 7A, the rear primary wheels 130*b* make first contact with the ground 20. The spring 270 is shown in the free state, wherein the lever 164 and the secondary wheels 162 are biased downward, while the secondary wheels 162 do not yet reach the ground 20 itself. Further lowering the front portion of the foot, as shown in FIG. 7B, initiates contact of the secondary wheels with the ground 20 while the front primary wheels 130*a* may still be offset from the ground 20. As the front primary wheels 130*a* are also lowered to contact the ground 20, as shown in FIG. 7C, all of the primary and secondary wheels 130 and 162, respectively, are in contact the ground 20 and roll forward.

Figure 7D:
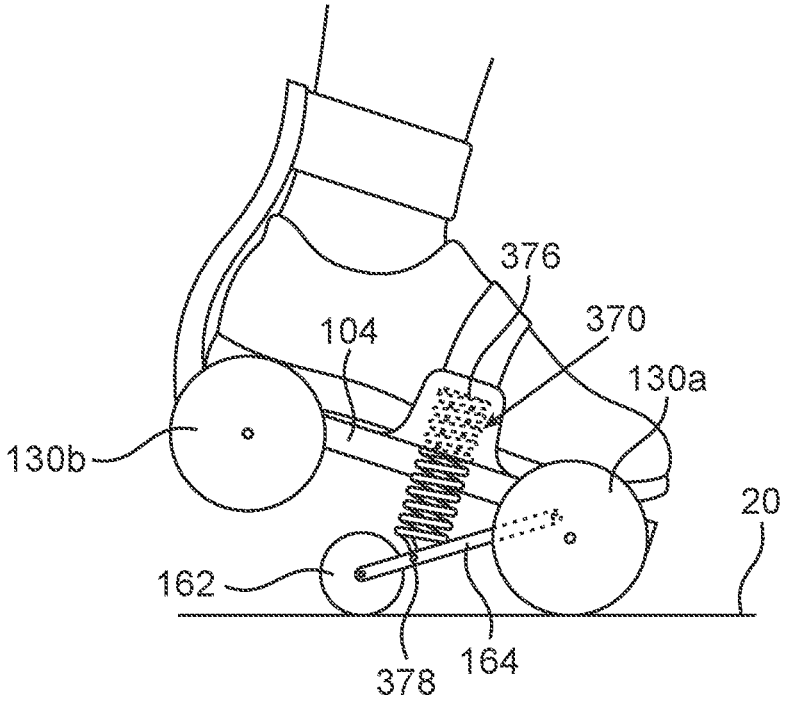
Figure 7E:
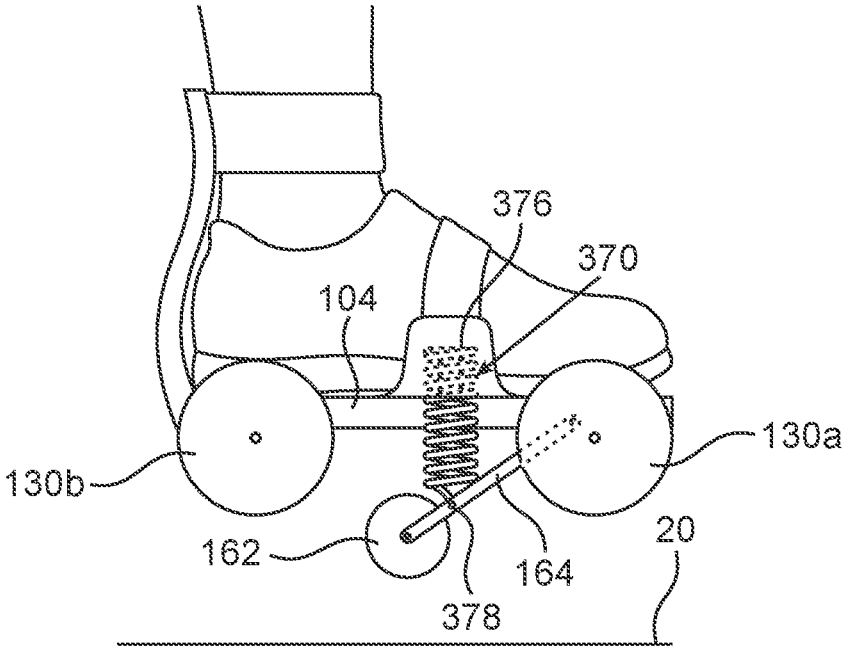

When the rear primary wheels 130*b* are lifted upward as shown in FIG. 7D, the secondary wheels 162 may remain in a pressed state (i.e., in contact with the ground 20) while the front primary wheels 130*a* are still pressed against the ground 20. The spring 370 may discharge the accumulated energy therein, so as to produce adjustable assisting lifting force that may further support forward thrust motion at the end of the step. This assisting force may help in reduction and regulation of the counter torque, in terms of amplitude and/or volatility, which is applied to the motor shaft 142 by the foot's rolling motion, during positioning of the leading foot on the ground (FIGS. 7A-7B) and during the forward thrust motion (FIG. 7D). Specifically, the assisting force may reduce the maximum torque requirement from the motor 140, thereby enabling overall weight reduction. When the front primary wheels 130*a* are lifted as well, as shown in FIG. 7E, the spring 370 may extend to the free state.

While the spring 370 may lack the advantage offered by a pneumatic/hydraulic drive unit 270, in keeping the secondary wheels 162 in a retracted state when the foot is in the air, it may provide an alternative advantage by providing a simpler structural configuration, in which actuators and pressure sensors are not required, thereby potentially simplifying structural complexity, lowering costs and lowering the overall weight of the mobility enhancement system 100.

While the pneumatic/hydraulic drive unit 270 is shown in FIGS. 6A-6E to be movable from a retracted state when the foot is in the air, to the lowered state in which the secondary wheels 162 may contact the ground, it will be clear that alternatively, the motorized walking enhancement platform 102 may be provided with pneumatic/hydraulic drive units 270 configured to be biased downward in a free state when the foot is in the air, and the pneumatic/hydraulic piston may be movable upward into the pneumatic/hydraulic cylinder 272 to a pressed state, during which the secondary wheels 162 may contact the ground 20, similar to the states shown for a spring 370 in FIGS. 7A-7E.

While pneumatic/hydraulic drive units 270 and spring 370 are described herein above, it will be clear that other forms of lever height regulators may be similarly applicable, such as motorized or robotic arms controlled by the control circuitry 154.

In some embodiments, a motorized walking enhancement platform 102 provided with a lever height regulator in the form of a spring 370 (or a motorized arm) can be accompanied by a separate braking system 194. These solutions may be inferior to pneumatic/hydraulic drive units 270 as in such cases, the pneumatic/hydraulic actuator 182 is not shared by a pneumatic/hydraulic drive unit 270. In other embodiments, a motorized walking enhancement platform 102 provided with a lever height regulator in the form of a spring 370 (or a motorized arm) may be devoid of a braking system 194, which may result in inferior functionality of the mobility enhancement system 100 due to its inability to properly compensate for extreme magnitudes of skid forces 32, as elaborated herein above. Nevertheless, such embodiments may be applicable if the system 100 is designed in such a manner that excessive skid forces 32 are not expected to form or to cause an overwhelming problem that cannot be properly compensated by the motor 140 alone.

Figure 8A:
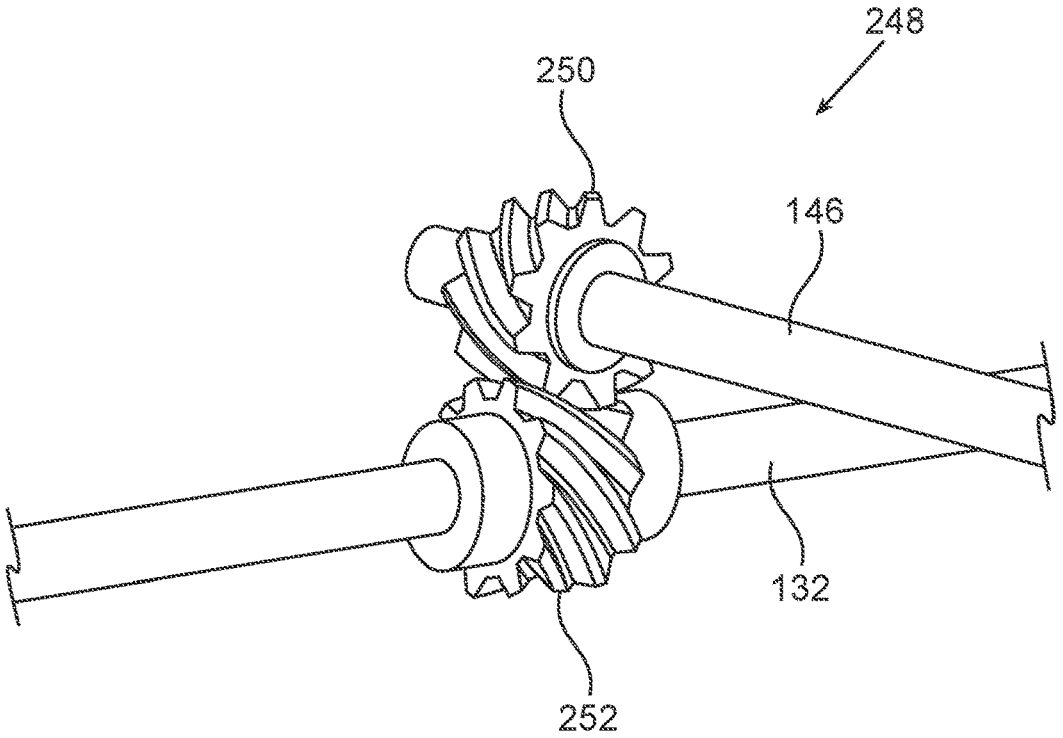
FIG. 8A shows a worm-gear transmission mechanism, according to some embodiments.
Figure 8B:
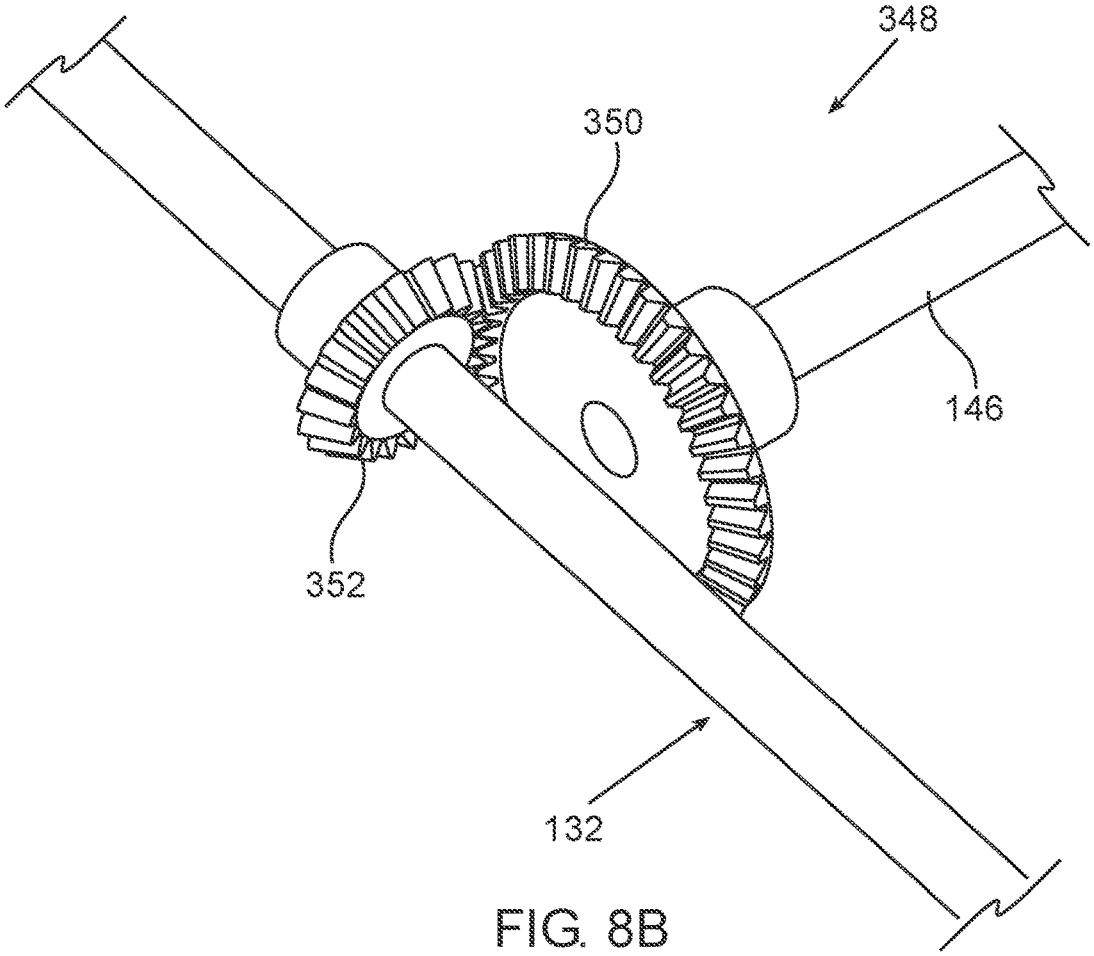
FIG. 8B shows a beveled-gear transmission mechanism, according to some embodiments.

Reference is now made to FIGS. 8A-8B, showing different implementations of non-differential transmission mechanisms 148. According to some embodiments, the non-differential transmission mechanism 148 comprises a worm-gear transmission mechanism 248, as shown in FIG. 8A. The longitudinal shaft member 146 can include a longitudinal worm gear, which is meshed with a lateral worm gear 252 of the axle 132.

According to some embodiments, the non-differential transmission mechanism 148 comprises a beveled-gear transmission mechanism 348, as shown in FIG. 8B. The longitudinal shaft member 146 can include a longitudinal bevel gear 350, meshed at one side with a lateral bevel gear 352 of the axle 132. While two exemplary implementations for non-differential transmission mechanism 148 are shown in FIGS. 8A-8B, it will be clear that other non-differential transmission mechanism 148 known in the art for perpendicular transfer of rotational movement, are contemplated, including mechanisms that include various bevel gears, helical gears, crown gears, and the like.

According to some embodiments, the motorized walking enhancement system 102 may decelerate to a full stop, finally locking all primary wheels 130 and preventing rotational movement thereof. This may be required in cases in which the walker is interested to prevent such rolling motion, for example during step-walking. In such cases, the walker may send a command via the remote-control device 60 to lock the wheels. The command is sent, for example wirelessly, to both control circuitries 154 of both motorizes walking enhancement platforms 102, which decelerate the motor 130 up to a full stop, and further locks the primary wheels 130 by applying efficient braking mechanisms (not shown) as known in the art.

A command to unlock and reactivate the rolling motion of the mobility enhancement system 100 may be sent in the same manner via the remote-control device 60, for example once the walker reached a relatively flat ground profile.

Figure 10A:
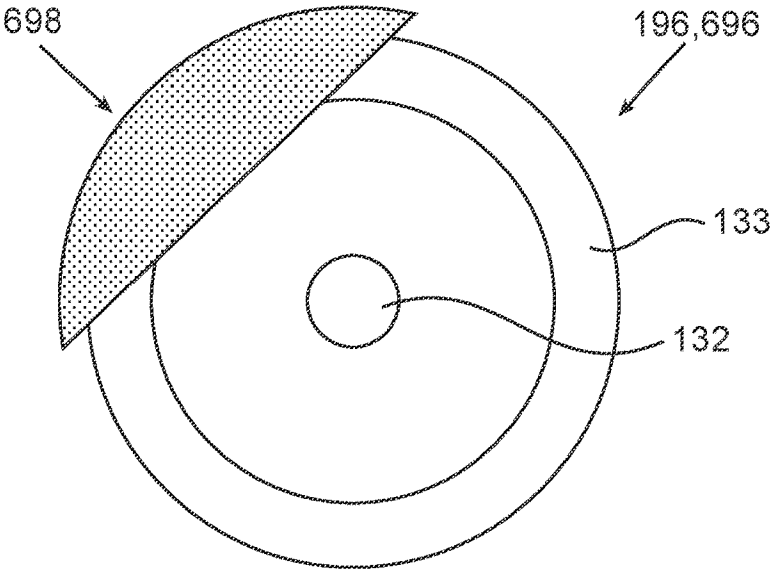
FIG. 10A shows a schematic side view of a pneumatic/hydraulic disc braking unit, according to some embodiments.
Figure 10B:
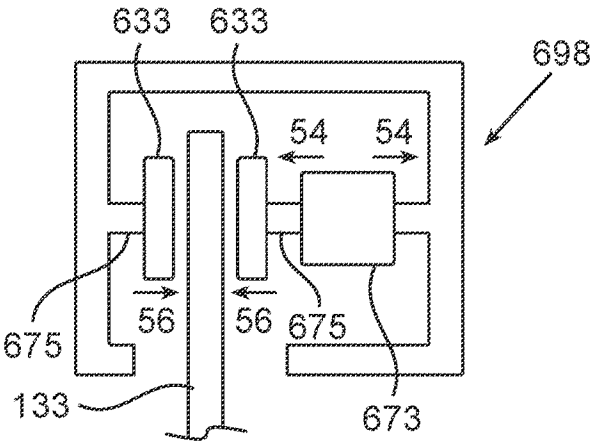
FIG. 10B shows a schematic partial sectional view of the pneumatic/hydraulic disc braking unit of FIG. 10A.
Figure 9:
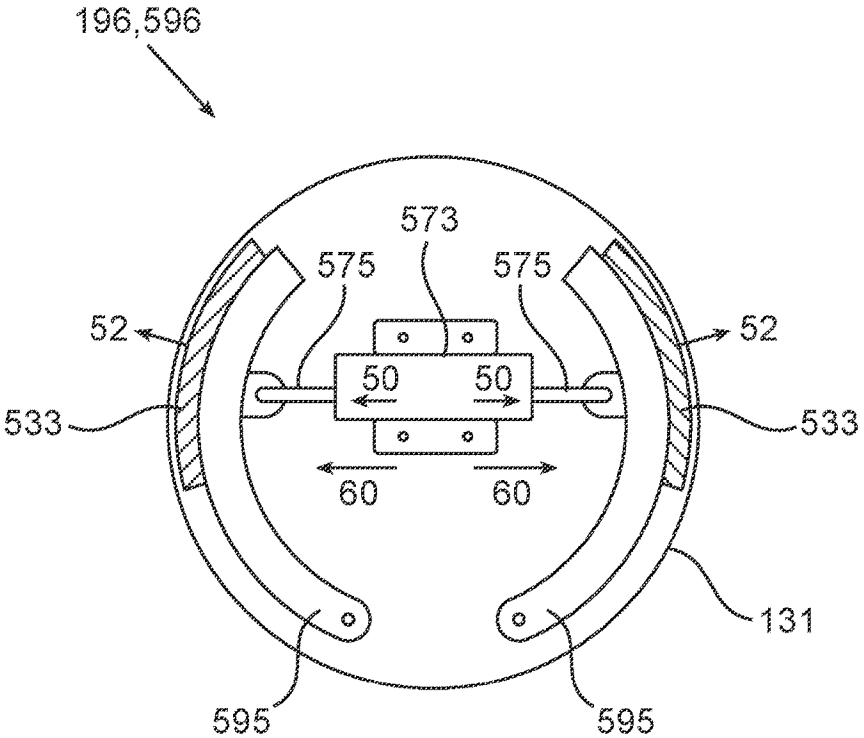
FIG. 9 shows a schematic side view of a pneumatic/hydraulic drum braking unit, according to some embodiments.

Reference is now made to FIGS. 9-10B, showing different types of pneumatic/hydraulic breaking units 196. FIG. 9 shows a schematic side view of a pneumatic/hydraulic drum breaking unit 596. Each of the front primary wheels 130*a* may be provided with a drum 131 affixed thereto and rotatable therewith. A pneumatic/hydraulic drum breaking unit 596 comprises a bi-directional cylinder 573 provided with two opposite pneumatic/hydraulic pistons 575 extending from opposite sides of the cylinder 573 and radially movable outward in directions 50. The pistons 575 are attached to brake shoes 595 provided with brake pads or linens 533 attached thereto and extending radially outward. The brake pads 533 are spaced away from the edges of the drum 131 in a relaxed state.

When the braking system 194 is actuated, pressure is applied by air or hydraulic fluid, such as oil, in the radially outward directions 60, pushing the pistons 575 along with the brake shoes 595 radially outward, pressing the brake pads 533 against the edges of the drum 131. The friction between the brake pads 533 and the drum 131 causes the drum to stop rotating, or alternatively, hinders the rotational movement so as to lower its rotational speed, as a function of the extent to which the brake pads 533 are pressed against the drum 131.

FIGS. 10A and 10B shows a schematic side view and a partial sectional view of a pneumatic/hydraulic disc braking unit 696. Each of the front primary wheels 130*a* may be provided with a disc 133 affixed thereto and rotatable therewith. A pneumatic/hydraulic disc braking unit 596 comprises a caliper assembly 698, which includes a bi-directional cylinder 673 provided with pneumatic/hydraulic pistons 575 disposed laterally on both sides of the disk 133, and laterally movable toward or away from the disc 133 in directions 56. The pistons 575 are attached to brake pads or linens 633, which are spaced away from the sidewalls of the disc 133 in a relaxed state.

When the braking system 194 is actuated, pressure is applied by air or hydraulic fluid, such as oil, in directions 54, pushing the pistons 675 along with the brake pads 633 against the sidewalls of the disc 133. The friction between the brake pads 633 and the disc 133 causes the disc 133 to stop rotating, or alternatively, hinders the rotational movement so as to lower its rotational speed, as a function of the extent to which the brake pads 633 are pressed against the disc 133.

While two braking mechanisms, such as a pneumatic/hydraulic drum braking mechanism 596 and a pneumatic/hydraulic disc braking mechanism 696 are described and illustrated herein, it will be clear that these specific mechanisms are provided for the sake of example only, and that other types of pneumatic or hydraulic braking mechanisms known in the art, are contemplated for the braking unit 194.

According to some embodiments, the motorized walking enhancement platform 102 further comprises a protective housing (not shown) that can be attached to the lower frame surface 108 and encompass components attached thereto, such as components of the drive assembly 124 and the control circuitry 154, so as to protect such components from being damaged by obstacle in the surrounding environment. According to some embodiments, various components of the motorized walking enhancement platform 102 are waterproof, configured to withstand at least rainy weather.

Advantageously, a mobility enhancement system 100 designed for rolling while walking, preferably that is also lightweight and easily controllable, would provide a safe walking environment for walker regardless of their level of expertise. Advantageously, the structure and configuration of the various components of the drive assembly, including the motor 140, the speed reduction units 144, the non-differential transmission mechanisms 148, the drive line 136 and axles 132, and the primary wheels 130, may together provide superior characteristics in terms maximal torque, accuracy of speed control, platform 102 stability and traction, long-term durability, all of which provided in minimal weight of the overall platforms 102.

It is appreciated that various components of the mobility walking enhancement platform 102 are made of polymeric materials, lightweight metal materials, or combinations thereof. According to some embodiments, the weight of each motorized walking enhancement platform 102, excluding components that are not carried by the user's foot, such as the leg brace 186 and the power source 184, is equal to or lower than 2.5 kg, thereby allowing sufficiently comfortable swinging of the motorized walking enhancement platform 102 at the end of each step up to the beginning of the subsequent step. According to some embodiments, the weight of each motorized walking enhancement platform 102, excluding components that are not carried by the user's foot, such as the leg brace 186 and the power source 184, is equal to or lower than 2 kg.

The motorized walking enhancement platforms 102 amplify the movement of the user. This walking movement enhancement is similar to that of walking on an airport moving walkway. While the user is walking normally, the actual speed of advancement is faster, without expending extra effort. Each of the points of action-and-reaction that underpin the full motion function of the mobility enhancement system 100, constitutes a contact point of the wheels 130 with the ground 20, wherein all forces, either internal and external, interact and need to be balanced instantaneously, in order to maintain the walker's longitudinal balance and stability, and apply the net forward force 30 that is required to maintain the predefined constant steady rolling speed of both motorized walking enhancement platforms 102.

The controllable measurement and instantaneous readjustment mechanism, configured to keep all of the primary wheels 130 rolling at a constant preset speed all the times, provides a substantially stable movement of the motorized enhancement walking platforms 102 on the ground 20 at any instant. The digital control function of the control circuitry 154, following signals sensed by the rotations speed sensors 190 commensurate to incremental changes in the rotation speed of components of the drive assembly 124, such as the motor shaft 140 or the axles 132, responds by incrementally restoring the platform's 102 rolling speed in a proportionally incremental manner, corresponding to the motor's 140 driving torque, through the motor's 140 electric drive unit. This enables the walker to maintain natural walking balance without needing to make any particular effort.

The overall configuration of the components of the motorized walking enhancement platforms 102 as described herein above, advantageously obviates the use of additional or higher-weight components included in alternative devices known in the art, thereby simplifying usage and optimizing the weight balance of the current system 100 enabling simpler adoption even by unexperienced or first-time users.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. No feature described in the context of an embodiment is to be considered an essential feature of that embodiment, unless explicitly specified as such.

Although the invention is described in conjunction with specific embodiments thereof, it is evident that numerous alternatives, modifications and variations that are apparent to those skilled in the art may exist. It is to be understood that the invention is not necessarily limited in its application to the details of construction and the arrangement of the components and/or methods set forth herein. Other embodiments may be practiced, and an embodiment may be carried out in various ways. Accordingly, the invention embraces all such alternatives, modifications and variations that fall within the scope of the appended claims.

The invention claimed is:

1. A motorized walking system, comprising:

two motorized walking enhancement platforms, wherein each of the two motorized walking enhancement platforms comprises:

a base frame;

a drive assembly attached to the base frame, the drive assembly comprising:

a front lateral sub assembly, comprising a couple of front primary wheels affixed to both sides of a front axle;

a rear lateral sub assembly, comprising a couple of rear primary wheels affixed to both sides of a rear axle;

a drive line comprising:

a motor having a motor shaft protruding longitudinally from both sides of the motor;

a front longitudinal shaft member coupled to the motor shaft via a front speed reduction unit; and a rear longitudinal shaft member coupled to the motor shaft via a rear speed reduction unit;

a front non-differential transmission mechanism, configured to translate rotational movement of the of the front longitudinal shaft member to rotational movement of the front axle;

a rear non-differential transmission mechanism, configured to translate rotational movement of the rear longitudinal shaft member to rotational movement of the rear axle;

a control circuitry configured to control at least the functionality of the motor, wherein the control circuitry is configured to receive feedback corresponding to the momentary rotation speed of the primary wheels, compare the momentary rotation speed to a corresponding to a pre-set rotation speed, and if the momentary rotation speed is higher or lower than the pre-set rotation speed, to provide controlling signals configured to neutralize such change by readjusting the rotation torque of the motor, so as to revert the rotation speed of the primary wheels back to the pre-set desired speed.

2. The motorized walking system of claim 1, wherein the motor includes a brushless DC motor.

3. The motorized walking system of claim 1, wherein each of the front gear reduction unit and the rear reduction unit comprises a planetary gear arrangement.

4. The motorized walking system of claim 1, wherein each of the two motorized walking enhancement platforms further comprises a communication unit, configured to wirelessly communicate with a remote-control device.

5. The motorized walking system of claim 1, wherein each of the drive assemblies further comprises at least one rotation speed sensor electronically coupled to the control circuitry, and configured to continuously measure and generate a signal commensurate with the rotation speed of the component of the drive assembly it is attached to, thereby providing the feedback to the control circuitry.

6. The motorized walking system of claim 5, wherein the at least one rotation speed sensor comprises at least two rotation speed sensors, coupled to both sides of the motor shaft.

7. The motorized walking system of claim 5, wherein the at least one rotation speed sensor is coupled to at least one of the front axle and/or the rear axle.

8. The motorized walking system of claim 5, wherein the at least one rotation speed sensor comprises an absolute encoder.

9. The motorized walking system of claim 1, wherein the control circuitry is configured to receive the feedback, perform the comparison and provide readjustment signals to the motor within a time period equal or lower than 0.05 seconds.

10. The motorized walking system of claim 1, wherein each of the two motorized walking enhancement platforms further comprises a pair of secondary wheels, wherein each secondary wheel is coupled to the base frame via a lever, and wherein the vertical position of each secondary wheel relative to the base frame is displaceable via a lever height regulator.

11. The motorized walking system of claim 10, wherein the lever includes a rigid pivotable arm, attached to the base frame via a hinge.

12. The motorized walking system of claim 10, wherein the lever height regulator includes a pneumatic/hydraulic drive unit, comprising a pneumatic/hydraulic piston attached to the lever at a pneumatic/hydraulic piston lower end, and vertically movable through a pneumatic/hydraulic cylinder.

13. The motorized walking system of claim 12, wherein the motorized walking enhancement platform further comprises a pair of actuators, wherein each actuator comprises an actuator sub-controller and is coupled to the corresponding pneumatic/hydraulic drive unit via a lever transmission line, and wherein each actuator is configured to control the vertical position of the pneumatic/hydraulic piston lower end.

14. The motorized walking system of claim 10, wherein the lever height regulator includes a spring.

15. The motorized walking system of claim 1, wherein each of the front and rear non-differential transmission mechanisms comprises a worm-gear transmission mechanism, wherein the corresponding longitudinal shaft member comprises a longitudinal worm gear, and wherein the corresponding axle comprises a lateral worm gear meshed with the longitudinal worm gear.

16. The motorized walking system of claim 1, wherein each of the front and rear non-differential transmission mechanisms comprises a beveled-gear transmission mechanism, wherein the corresponding longitudinal shaft member comprises a longitudinal bevel gear, and wherein the corresponding axle comprises a lateral bevel gear meshed with the longitudinal bevel gear.

17. The motorized walking system of claim 1, wherein the weight of each of the two motorized walking enhancement platforms is equal to or lower than 2.5 kg.

18. The motorized walking system of claim 1, wherein each of the two motorized walking enhancement platforms further comprises an ergonomic leg brace with a shin/calf strap, and configured to house a power source.

19. The motorized walking system of claim 1, wherein each of the two motorized walking enhancement platforms further comprises at least one adjustable foot strap.

20. The motorized walking system of claim 1, wherein each of the two motorized walking enhancement platforms further comprises a rear extension, extending upward from a rear frame portion of the base frame.

* * * * *